US008241085B2

(12) United States Patent
Hoeting

(10) Patent No.: US 8,241,085 B2
(45) Date of Patent: Aug. 14, 2012

(54) MOTORIZED DOLL

(75) Inventor: Michael G. Hoeting, Cincinnati, OH (US)

(73) Assignee: Bang Zoom Design, Ltd., Cincinnati, OH (US)

( * ) Notice: Subject to any disclaimer, the term of this patent is extended or adjusted under 35 U.S.C. 154(b) by 337 days.

(21) Appl. No.: 12/700,838

(22) Filed: Feb. 5, 2010

(65) Prior Publication Data

US 2010/0216370 A1 Aug. 26, 2010

Related U.S. Application Data

(60) Provisional application No. 61/208,261, filed on Feb. 23, 2009.

(51) Int. Cl.
*A63H 13/00* (2006.01)

(52) U.S. Cl. ..... 446/355

(58) Field of Classification Search ..... 446/355, 446/354

See application file for complete search history.

(56) References Cited

U.S. PATENT DOCUMENTS

| | | | | |
|---|---|---|---|---|
| 3,704,543 | A * | 12/1972 | Giroud | 446/355 |
| 4,312,150 | A | 1/1982 | Terzian | |
| 5,045,015 | A * | 9/1991 | Arad et al. | 446/355 |
| 5,735,726 | A | 4/1998 | Cohen | |
| 6,645,036 | B1 * | 11/2003 | Lund et al. | 446/355 |

* cited by examiner

*Primary Examiner* — Michael Dennis
(74) *Attorney, Agent, or Firm* — Wood, Herron & Evans, LLP

(57) ABSTRACT

A motorized doll includes an upper body portion and a lower body portion. The upper body portion may include a torso and a pair of arms. The lower body portion may include a pelvis connected to the torso at a universal joint, a pair of legs, and a pair of feet rotatable with respect to the legs. The doll is actuated to walk by a torso motor which drives the torso to tilt and rotate about the universal joint, which causes the doll to shift from foot to foot and repeatedly rotate forwards in a realistic walking motion. The doll includes a shoulder motor for rotating the pair of arms and a pelvis motor for driving the legs between a standing position and one of a crawling position or sitting position depending on the position of the pair of arms when the doll is tipped forward.

8 Claims, 17 Drawing Sheets

MOTORIZED DOLL

CROSS REFERENCE TO RELATED APPLICATION

This application claims the benefit of U.S. Provisional Patent Application Ser. No. 61/208,261 to Hoeting, filed Feb. 23, 2009, the disclosure of which is incorporated by reference in its entirety.

FIELD OF THE INVENTION

The present invention relates to motorized dolls that can move between various positions, and more specifically, to motorized dolls configured to crawl, sit, crouch, stand, and walk.

BACKGROUND OF THE INVENTION

Motorized dolls have been a favorite toy of children for many years. Conventional motorized dolls include internal motors and control circuits which can move limbs of the doll or make noises in response to impetus from a child. In order to make the dolls more life-like, doll manufacturers have enabled some dolls to crawl across a support surface. As robotic controls became more sophisticated, doll manufacturers then enabled other dolls to walk across a support surface. However, the conventional walking dolls suffer from various drawbacks.

In order to create a realistic walking motion, the internal motors and gears of a motorized doll would have to be very complex to simulate all the nuances of the human body as it takes a step. Not only would the feet and legs need to be controlled precisely, the upper body would also have to be controlled to prevent the doll from tipping over or moving robotically. The complexity of such systems would increase the cost of these conventional walking dolls significantly, which would make the resulting dolls impractical to sell. Thus, doll manufacturers have simplified the internal motors and control circuits to control cost. The dolls are limited to moving in an unnatural manner with these simplified internal components, and these conventional dolls are also generally limited to standing and walking operations.

In a similar fashion, other conventional dolls have been developed which can sit down and stand back up. One example of such a doll is disclosed in U.S. Pat. No. 4,312,150 to Terzian. Again, these dolls suffer from a number of problems. The doll disclosed in Terzian requires 150 degree rotation of each leg to move between the various positions, but this amount of rotation is unnatural for a human leg. The legs of conventional sitting and standing dolls are generally limited to a very specific geometry in order to allow the motorized doll to move between the two positions. The geometry of these legs and the internal components of these conventional motorized dolls make it impractical for the dolls to have any other function other than standing up and sitting down.

The target market for many of these motorized dolls is infants and toddlers just learning how to walk. Thus, a motorized doll that can convincingly simulate the movements of an infant or toddler learning how to walk is desirable. Consequently, it would be advantageous to develop a motorized doll that can perform multiple functions in a realistic manner without requiring extensive and complicated internal components.

SUMMARY OF THE INVENTION

In one embodiment, a motorized doll adapted to walk on a support surface includes an upper body portion, a lower body portion, a universal joint, a torso motor, and a pivot crank. The upper body portion has a torso, while the lower body portion includes a pelvis and first and second legs extending from the pelvis.

The lower body portion also includes first and second feet coupled for rotation with respect to the first and second legs at respective first and second generally vertical foot axes. The universal joint is coupled for rotation with the torso along a torso axis and coupled for rotation with the pelvis along a pivot axis that is generally perpendicular to the torso axis, thereby allowing a blended motion of the torso with respect to the pelvis. The torso motor is positioned on the upper body portion. The pivot crank has a first end coupled to the torso motor and a second end coupled to the pelvis at a crank axis generally parallel to the pivot axis. The torso motor pivots the torso about the torso axis and the pivot axis simultaneously to produce a walking movement of the doll.

More specifically, a method of inducing a motorized doll to walk on a support surface is provided. The doll includes a torso, a pelvis coupled to the torso at a pivot axis, first and second legs extending from the pelvis, and first and second feet coupled to the respective first and second legs. The first and second feet are rotatable with respect to the first and second legs, and the doll further includes a torso motor. The method includes driving the torso motor to pivot the torso over the first leg to place all of the weight of the doll on the first foot. The doll is then rotated forward at the first leg with respect to the first foot until the second foot lands on the support surface. In a similar manner, the torso motor then pivots the torso over the second leg so that the weight of the doll is placed on the second foot. The doll is then rotated forward at the second leg with respect to the second foot until the first foot lands on the support surface. The forward rotations of the doll cause the doll to take a step forward at the completion of the method, and the cycle can be repeated to continue a walking movement.

In another embodiment, a motorized doll is adapted to move between a standing position, a sitting position, a crouching position, and a crawling position interchangeably. The doll includes an upper body portion, a lower body portion, a shoulder motor, a pelvis motor, and first and second linking members. The upper body portion includes a torso, a pair of arms coupled for rotation with the torso about an arm axis, and a head coupled to the torso. The lower body portion includes a pelvis, first and second legs coupled for rotation with the pelvis about respective hip axes, and first and second feet coupled for rotation with respect to the first and second legs about generally horizontal ankle axes. The shoulder motor is positioned in the torso and rotates the pair of arms. The pelvis motor is positioned in the pelvis and rotates the first and second legs about the pelvis in unison. Each of the first and second linking members includes a first end coupled to the pelvis and a second end coupled to the respective first or second foot. The linking members cause the first and second feet to rotate about the ankle axes when the pelvis motor rotates the first and second legs about the hip axes. The doll can therefore move between a standing position and a crouching position. From the crouching position, the first and second legs may be further rotated to tip the doll over in a forward direction. Once the doll tips over, the position of the pair of arms determines whether the doll moves into the crawling position or the sitting position from the crouching position.

More specifically, a method of inducing a motorized doll to move between predetermined positions is provided. The doll includes a pelvis, first and second legs coupled for rotation with the pelvis about hip axes, first and second feet coupled for rotation with the respective first and second legs about ankle axes, and a pelvis motor. The method includes driving the pelvis motor to rotate the first and second legs about the first and second hip axes. The method further includes rotating the first and second feet about the first and second ankle axes while the first and second legs rotate about the first and second hip axes. The doll then moves between a standing position and a crouching position. From the crouching position, the doll may be tipped over forwards by continued rotation of the first and second legs. In some embodiments, the doll may further include a torso with a rotatable pair of arms, and the location of these arms relative to the torso when the doll tips over forwards determines whether the doll moves into a sitting position or a crawling position.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
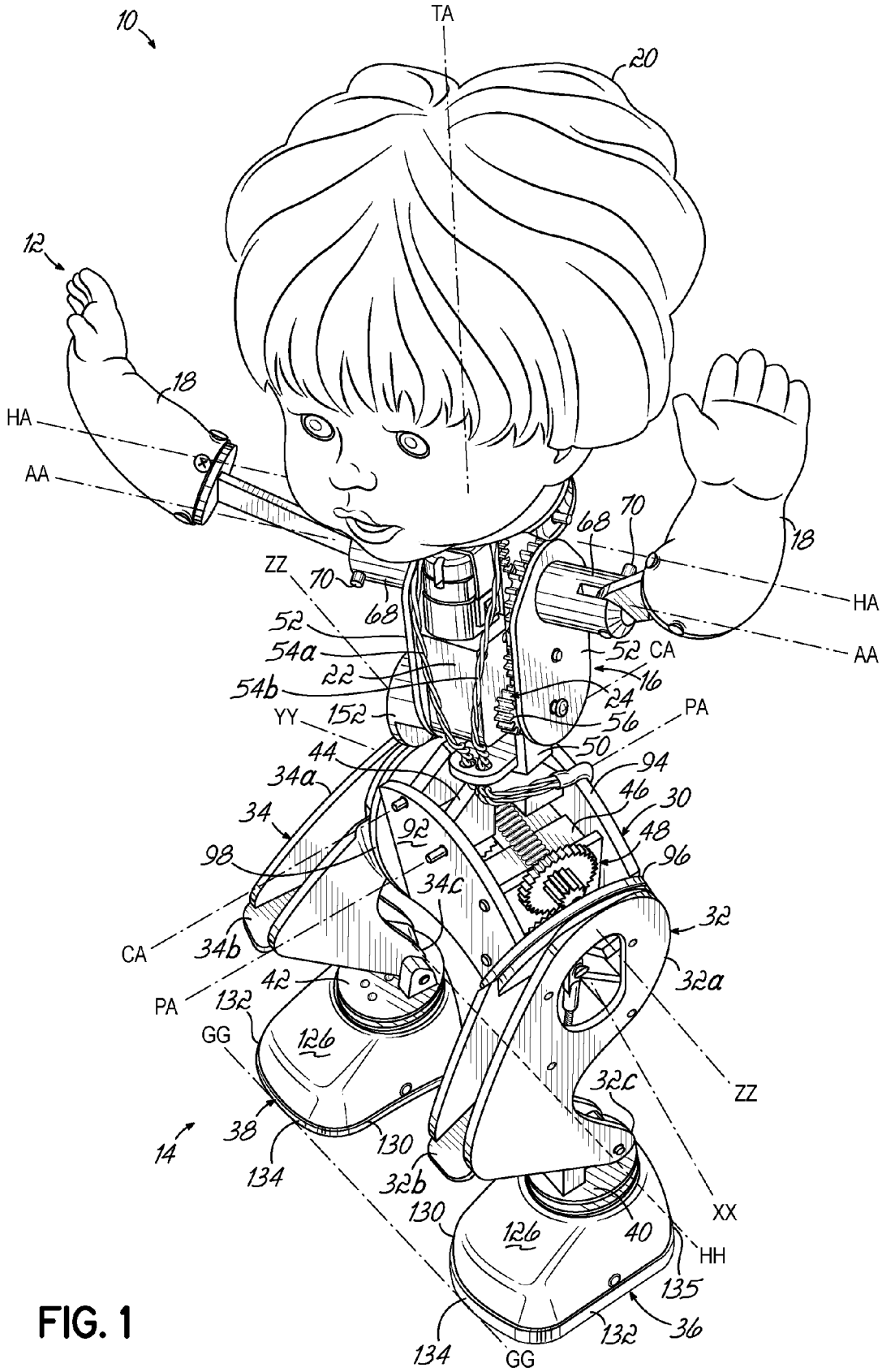
FIG. 1 is a perspective view of one embodiment of a motorized doll, illustrating various rotation axes.

FIGS. 1-4B illustrate one embodiment of a motorized doll 10 adapted for sitting, crawling, crouching, standing, and walking. As shown in FIG. 1, the doll 10 includes an upper body portion 12 and a lower body portion 14. The doll 10 typically includes an outer shell formed from plastic or other suitable material to form the various parts of a body, but the outer shell is not illustrated in the figures so that the internal drive train components may be displayed. The upper body portion 12 is formed by a torso 16, a pair of arms 18 coupled to the torso 16, and a head 20 coupled to the torso 16. A shoulder motor 22 and a corresponding shoulder drive train 24 are mounted on the torso 16 and are operable to rotate the pair of arms 18 through a generally horizontal arm axis AA as well as to rotate the head 20 through a generally horizontal head axis HA. A torso motor 26 and a corresponding torso drive train 28 are also mounted on the torso 16, the torso motor 26 being operable to induce walking or crawling movements of the doll 10 as will be explained in greater detail below.

The lower body portion 14 includes a pelvis 30, first and second legs 32, 34 extending generally outwardly from the pelvis 30, and first and second feet 36, 38 coupled to the respective first and second legs 32, 34 at first and second ankle members 40, 42. The torso 16 of the upper body portion 12 is coupled to the pelvis 30 at a universal joint 44, which allows the torso 16 to undergo a blended movement along multiple axes. As such, the universal joint 44 defines a generally horizontal pivot axis PA for the torso 16 as well as a generally vertical torso axis TA. A pelvis motor 46 and a corresponding pelvis drive train 48 are mounted on the pelvis 30, the pelvis motor 46 being operable to rotate the first and second legs 32, 34 along respective first and second hip axes XX, YY which are angled from a generally horizontal pelvis axis ZZ. The pelvis motor 46 enables the doll 10 to move between a standing position, a crouching position, a sitting position, and a crawling position interchangeably, as will be described in further detail below. As the pelvis motor 46 moves the doll 10 from a crouching position to either the sitting position or the crawling position, the doll 10 is tipped over a front tipping axis GG defined by the first and second feet 36, 38. Thus, the doll 10 is configured to move along all the various different axes AA, HA, PA, TA, XX, YY, ZZ, GG to produce realistic movements for the doll 10.

Figure 2A:
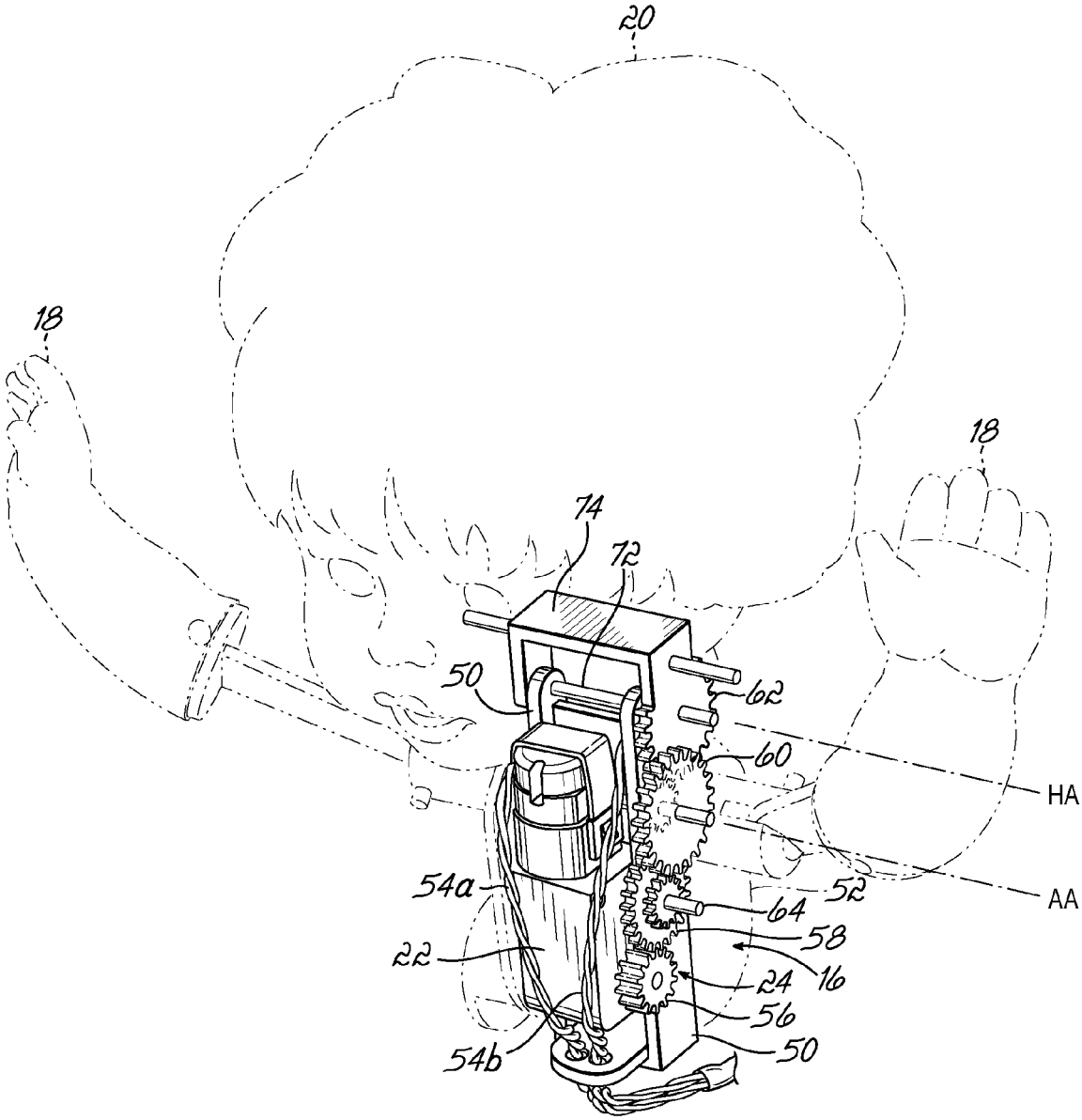
FIG. 2A is a front perspective view of the shoulder motor and corresponding drive train of the motorized doll of FIG. 1.
Figure 2B:
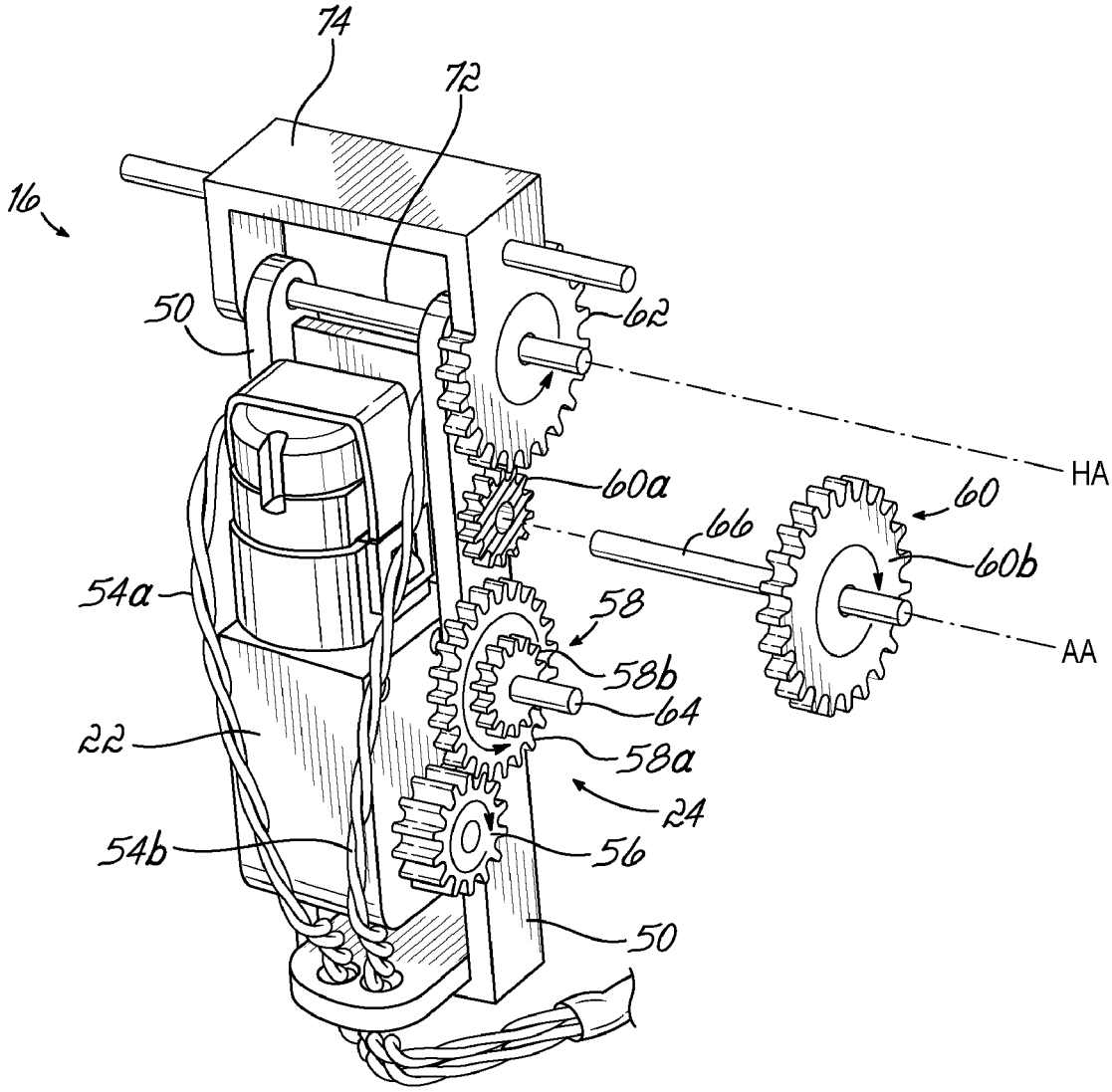
FIG. 2B is a partially-exploded view of the shoulder motor and corresponding drive train of FIG. 2A.
Figure 3:
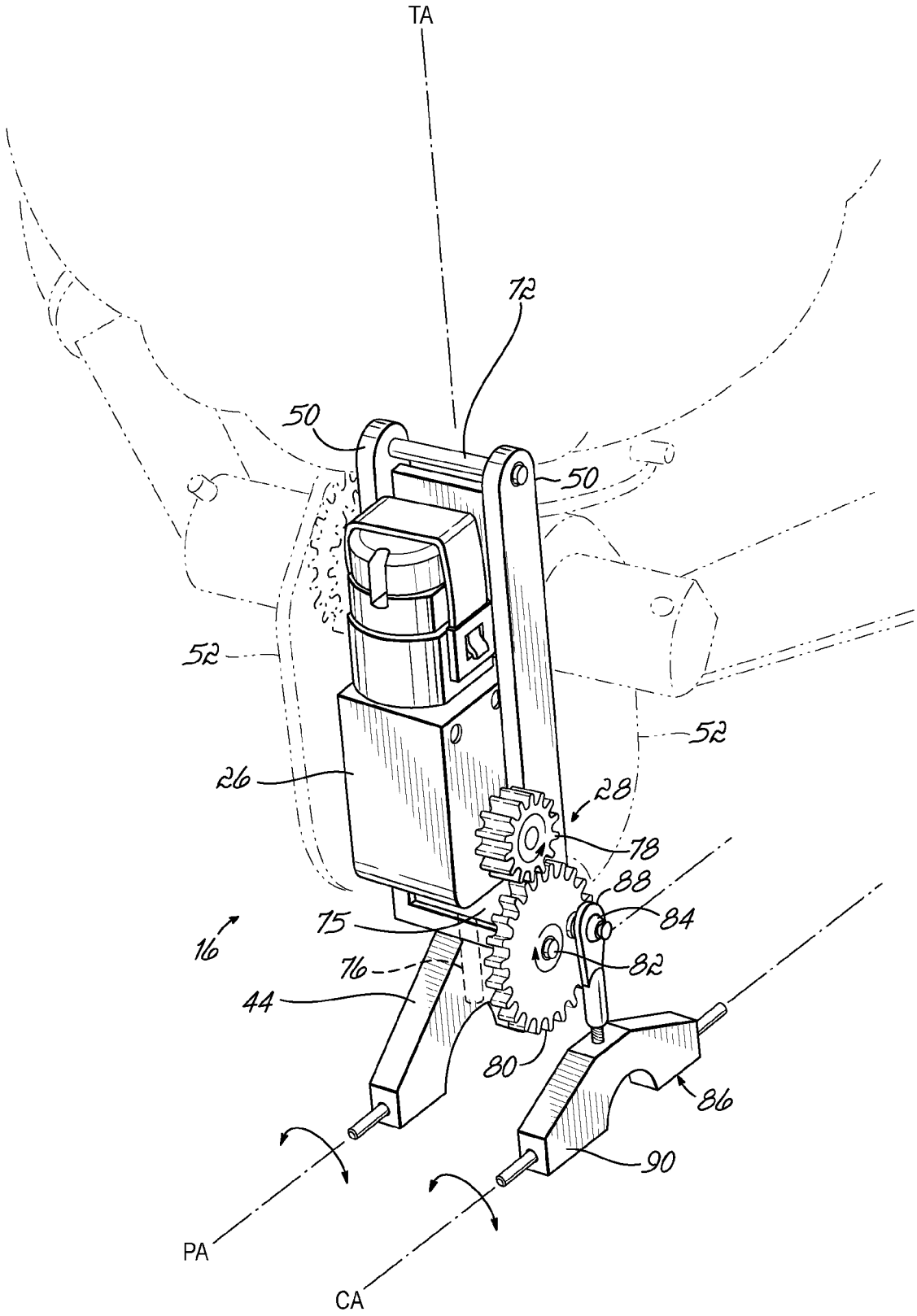
FIG. 3 is a rear perspective view of the torso motor and corresponding drive train of the motorized doll of FIG. 1.

As shown in the embodiment of FIGS. 2A-3, the torso 16 of the upper body portion 12 may be formed from a pair of interior support columns 50 and a pair of outer cover plates 52 (shown in phantom) on opposing sides of the interior support columns 50. The shoulder motor 22 and the torso motor 26 are located between the interior support columns 50, while the corresponding shoulder drive train 24 and torso drive train 28 are located between the respective interior support columns 50 and the outer cover plates 52 on opposing sides of the motors 22, 26. The interior support columns 50 and the pair of outer cover plates 52 may be made of rigid plastic material to protect the various internal drive train components of the upper body portion 12 from interference of snagging on other components of the motorized doll 10.

The shoulder motor 22 and shoulder drive train 24 are illustrated in FIGS. 2A and 2B. The shoulder motor 22 may be a conventional servo motor controlled by electrical power delivered through wires 54*a* leading to a power source such as a battery or printed circuit board (not illustrated). The shoulder motor 22 drives an output gear 56. The shoulder drive train 24 engages with this output gear 56 and includes a drive gear 58, an arm gear 60, and a head gear 62. The drive gear 58 includes an inner drive gear 58*a* meshed with the output gear 56 and an outer drive gear 58*b* that rotates with the inner drive gear 58*a* on a freely-rotatable drive axle 64. The arm gear 60 includes an inner arm gear 60*a* in mesh engagement with the inner drive gear 58*a* and an outer arm gear 60*b* in mesh engagement with the outer drive gear 58*b*. The arm gear 60 is mounted on an arm shaft 66 which is coupled to shoulder members 68 on opposing sides of the torso 16 and oriented along arm axis AA. The shoulder members 68 are coupled to the pair of arms 18 at arm hinges 70 that permit limited free movement of the pair of arms 18 with respect to the shoulder members 68. The head gear 62 is meshed with the inner arm gear 60*a* and mounted for rotation on a head axle 72 disposed along head axis HA. The head gear 62 may also include a neck portion 74 upon which the head 20 is mounted.

In one operation, the shoulder motor 22 drives the output gear 56 in a generally clockwise direction, which causes the drive gear 58 to rotate in a counter-clockwise direction (shown by arrows in FIG. 2B). The arm gear 60 then is forced to rotate in a clockwise direction, which would rotate the pair of arms 18 generally upwards from the pelvis 30 towards the head 20. At the same time, the inner arm gear 60*a* engages with the head gear 62 to force the head gear 62 to rotate in a counter-clockwise or opposite direction from the arm gear 60. This rotation of the head gear 62 would cause the head 20 of the doll 10 to rotate forwards. Consequently, the pair of arms 18 and the head 20 rotate in opposing directions such that when the pair of arms 18 is rotated upwardly towards the head 20, the head 20 is rotated forwards. The shoulder motor 22 can also drive the output gear 56 in a generally counter-clockwise direction in order to perform the opposite functions of rotating the pair of arms 18 downwards towards the pelvis 30 and rotating the head 20 backwards.

The torso motor 26 and torso drive train 28 are illustrated in FIG. 3. The torso motor 26 is mounted between the interior support columns 50 of the torso 16 and generally behind the shoulder motor 22. Like the shoulder motor 22, the torso motor 26 may be a conventional servo motor powered by an electricity source such as a battery via wires 54*b*. Directly below the torso motor 26, a torso axle block (not illustrated) is coupled to the interior support column 50 and supports a torso axle 76 extending through the universal joint 44. The torso axle 76 may be secured to the universal joint 44 at a collar so that the torso axle 76 and the torso 16 can freely rotate along torso axis TA with respect to the universal joint 44. The universal joint 44 may be a generally U-shaped member engaging the torso axle 76 along a central portion and pivotally engaging the pelvis 30 for rotation along pivot axis PA. Thus, the universal joint 44 allows the torso 16 to tilt from side to side about pivot axis PA and rotate along the torso axis TA.

The torso motor 26 includes an output gear 78 which may be driven in either rotational direction. The output gear 78 is located in mesh engagement with a walking drive gear 80, which is mounted for rotation on a walking drive axle 82 on the torso 16. The walking drive gear 80 includes a ball joint 84 coupled to an outer side of the walking drive gear 80. As the walking drive gear 80 rotates, the ball joint rotates around the walking drive axle 82. The torso drive train 28 further includes a pivot crank 86 having a socket 88 and a generally U-shaped member 90. The socket 88 engages with the ball joint 84 to form a ball-and-socket connection, while the U-shaped member 90 is pivotally coupled to the pelvis 30 along a crank axis CA which is parallel to the pivot axis PA of the universal joint 44. The U-shaped member 90 and the U-shaped portion of the universal joint 44 are adapted to pivot from side to side in unison. The walking drive gear 80 and the ball-and-socket connection may be placed within a plastic cover 152 or guard (shown in FIG. 1) to protect the dynamic components of the torso drive train 28 from interference or snagging on other components of the motorized doll 10.

In operation, the torso motor 26 drives the output gear 78 in a generally counter-clockwise direction, for example, as shown by the arrows in FIG. 3. The output gear 78 then drives the walking drive gear 80 and ball joint 84 to rotate in a generally clockwise direction. Because the socket 88 of the pivot crank 86 can only move pivotally around the crank axis CA, the rotation of the ball joint 84 within the socket 88 results in a blended tilting and rotation of the torso 16. More specifically, as the ball joint 84 rotates around the walking drive axle 82, the ball joint 84 moves generally up-and-down as well as front-to-back (using the standing doll as a reference for direction). As the ball joint 84 moves generally up-and-down with respect to torso 16, the U-shaped member 90 of the pivot crank 86 and the universal joint 44 are forced to pivot back and forth around respective axes CA, PA. This pivoting action is translated through the torso axle 76 to the torso 16 such that the torso 16 rocks or tilts from side to side with respect to the pelvis 30. At the same time, the front-and-back movement of the ball joint 84 with respect to the torso 16 causes the ball joint 84 to rotate within the socket 88, which translates to a repeated left-and-right rotation of the torso 16 and the torso axle 76 in the universal joint 44. Thus, the torso drive train 28 produces a blended movement of the torso 16 where the torso 16 tilts from side to side about pivot axis PA while turning slightly to the left and to the right about torso axis TA. This blended movement mimics the movement of a person's torso as he or she walks.

Figure 4A:
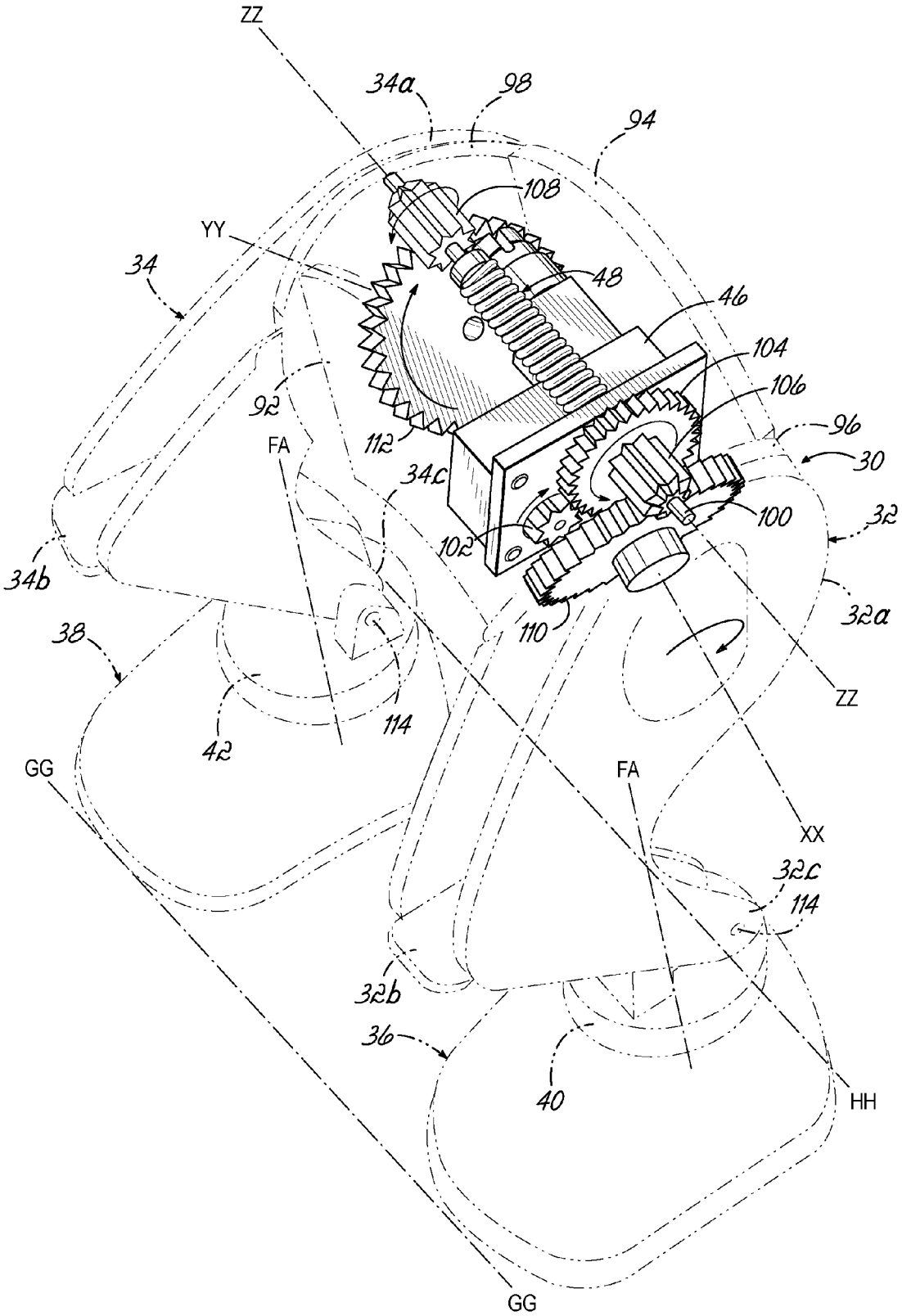
FIG. 4A is a front/side perspective view of the pelvis motor and corresponding drive train of the motorized doll of FIG. 1.
Figure 4B:
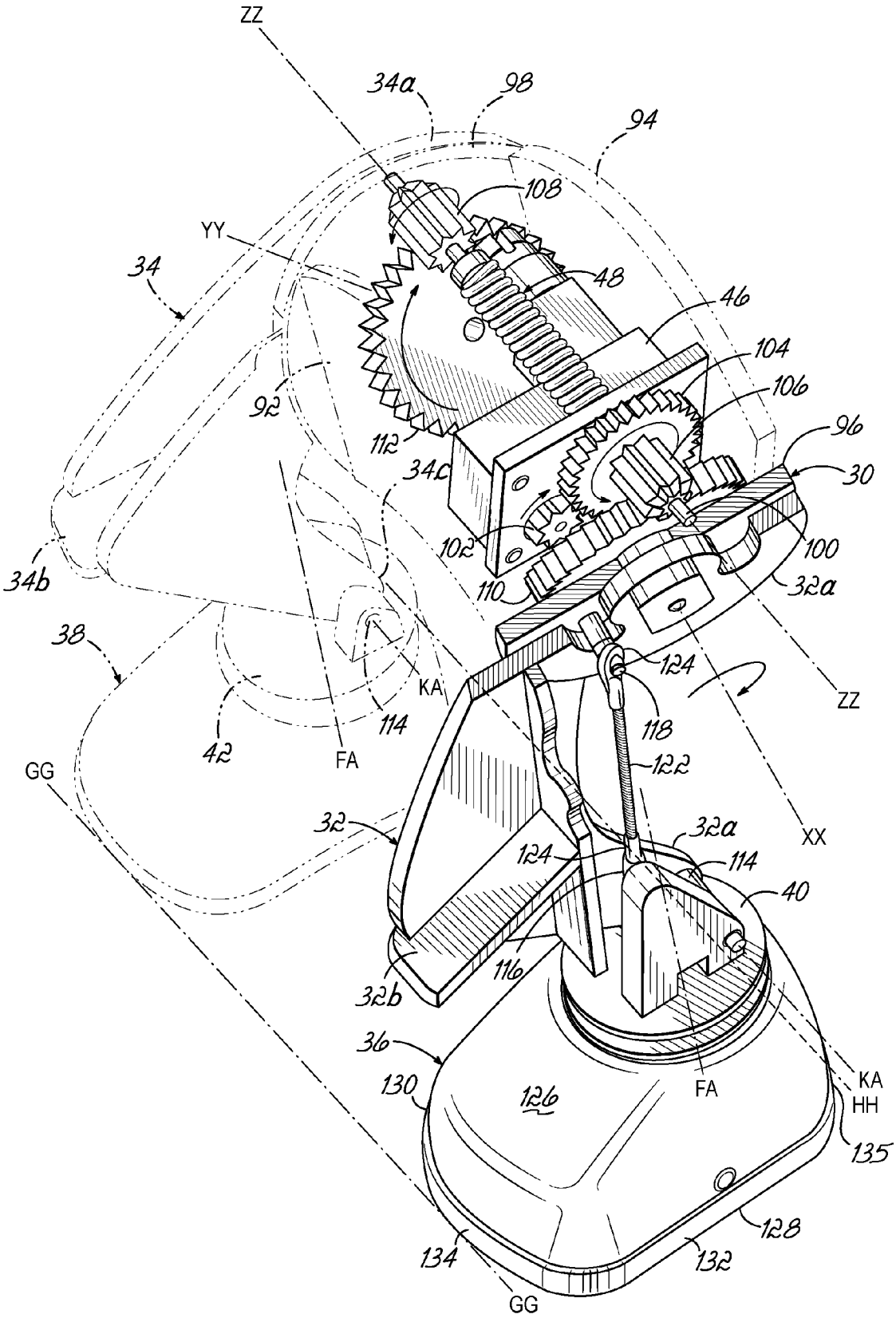
FIG. 4B is a partially-sectioned front/side perspective view of the pelvis motor, the corresponding drive train, and a first leg of the motorized doll of FIG. 1.

The pelvis motor 46 and pelvis drive train 48 are further illustrated in FIGS. 4A and 4B. The pelvis 30 includes front and back walls 92, 94 which engage the universal joint 44 and pivot crank 86 as described above, and first and second side walls 96, 98 on opposing sides of the front and back walls 92, 94. The pelvis motor 46 and a pelvis drive axle 100 are disposed within these pelvis walls 92, 94, 96, 98. The pelvis motor 46 includes an output gear 102 which is meshed with a pelvis drive gear 104 mounted on the pelvis drive axle 100. The pelvis drive axle 100 is therefore rotated along pelvis axis ZZ. The pelvis drive train 48 further includes first and second hip gears 106, 108 mounted for rotation on opposing ends of the pelvis drive axle 100. The first and second hip gears 106, 108 are mesh engaged with respective first and second leg gears 110, 112 adjacent to the first and second side walls 96, 98 of the pelvis 30.

A portion of the first and second leg gears 110, 112 extends through respective first and second side walls 96, 98 and rigidly engage the first and second legs 32, 34 at respective upper ends 32*a*, 34*a*. The side walls 96, 98 of the pelvis 30 and the first and second leg gears 110, 112 are angled slightly from a vertical orientation at a desired angle $\alpha$ such that the first and second legs 32, 34 rotate in unison along respective hip axes XX, YY. In order to provide stable standing, walking, and crouching, the desired angle $\alpha$ is preferably between 12 degrees and 30 degrees. In the embodiment illustrated, the desired angle $\alpha$ is 20 degrees. The pelvis motor 46 actuates rotation of the first and second legs 32, 34 by rotating the output gear 102, which forces the first and second hip gears 106, 108 and the first and second leg gears 110, 112 to rotate.

The first and second legs 32, 34 also include respective knee portions 32*b*, 34*b* and lower ends 32*c*, 34*c*. The knee portions 32*b*, 34*b* act as contact or support points for the doll in the crawling position, which will be described in detail below. The lower ends 32*c*, 34*c* are pivotally coupled to the first and second ankle members 40, 42 at ankle axles 114. The ankle axles 114 are located along generally horizontal ankle axes KA, as shown in FIG. 4B. Adjacent to the ankle axles 114, each ankle member 40, 42 includes a lower ball joint 116. A similar upper ball joint 118 is also formed on the outer surface of each side wall 96, 98 of the pelvis 30, and an arcuate cutout 120 is provided in the upper portions 32*a*, 34*a* of the first and second legs 32, 34 to accommodate the rotation of this upper ball joint 118 as the legs 32, 34 rotate with respect to the pelvis 30. A rigid linking member 122 including sockets 124 on both ends is engaged with the lower ball joint 116 and the upper ball joint 118. The linking member 122 constrains movement of the pelvis 30 with respect to the ankle members 40, 42 and therefore the feet 36, 38. As the first and second legs 32, 34 are rotated, the linking member 122 travels from a generally vertical orientation when the doll 10 is in a standing position to a nearly horizontal orientation when the doll 10 is in a crouching position. The linking member 122 ensures that the center of gravity of the doll 10 remains behind a front tipping axis GG (FIG. 4B) defined by a front edge 124 of each foot 36, 38, thereby preventing an undesired tipping over of the doll 10 prematurely. The linking member 122 also allows the doll 10 to be properly supported on the first and second feet 36, 38 while moving between the crouching position and the standing position.

The first and second feet 36, 38 are more clearly illustrated in FIGS. 4B (perspective) and 5D (section). The first and second feet 36, 38 each include an outer shell 126 having a bottom surface 128 with an inner edge 130, an outer edge 132, a front edge 134, and a rear edge 135. The rear edges 135 of the first and second feet 36, 38 also define a rear tipping axis HH (FIG. 4B), the significance of which is explained in detail below. In the standing position, the doll 10 is typically supported on the inner edges 130 of the first and second feet 36, 38 partially because of the angle between the first and second legs 32, 34 and the pelvis 30. Each of the first and second ankle members 40, 42 may include a downwardly directed axle channel 136 extending into the interior of the outer shell 126. Passing through the axle channel 136 is a foot axle 138 coupled to the bottom surface 128 of each of the first and second feet 36, 38. Thus, the first and second feet 36, 38 are rotatably mounted within the respective first and second ankle members 40, 42 along generally vertical foot axes FA (FIG. 4A), which coincide with the foot axles 138. As shown most clearly in FIG. 5D, the feet 36, 38 and the ankle members 40, 42 are also coupled with a tension spring 140 extending between a first tab 142 on the axle channel 136 and a second tab 144 on the outer shell 126 along the outer edge 132. The tension spring 140 biases the feet towards a nominal first position where the feet 36, 38 point generally forward (shown in FIGS. 4B and 5D). The tension spring 140 also allows the feet 36, 38 to rotate inwardly against the spring bias as part of the walking function explained in further detail below.

In some embodiments of the motorized doll 10, the outer shell 126 of the first or second foot 36, 38 provides a housing for a battery. The battery may alternatively be placed in the pelvis 30 of the doll 10 in other embodiments. Regardless of where the battery is located, the aforementioned wires 54 are routed from the battery to a controller (not pictured) and to the plurality of motors 22, 26, 46. The controller may be a printed circuit board programmed with algorithms to walk or move the doll 10 between various positions in response to user input, as these various functions will be described further below. The battery and controller may also be coupled to a speaker for producing simulated speaking and laughs and to sensors for sensing user input in some embodiments.

Figure 5B:
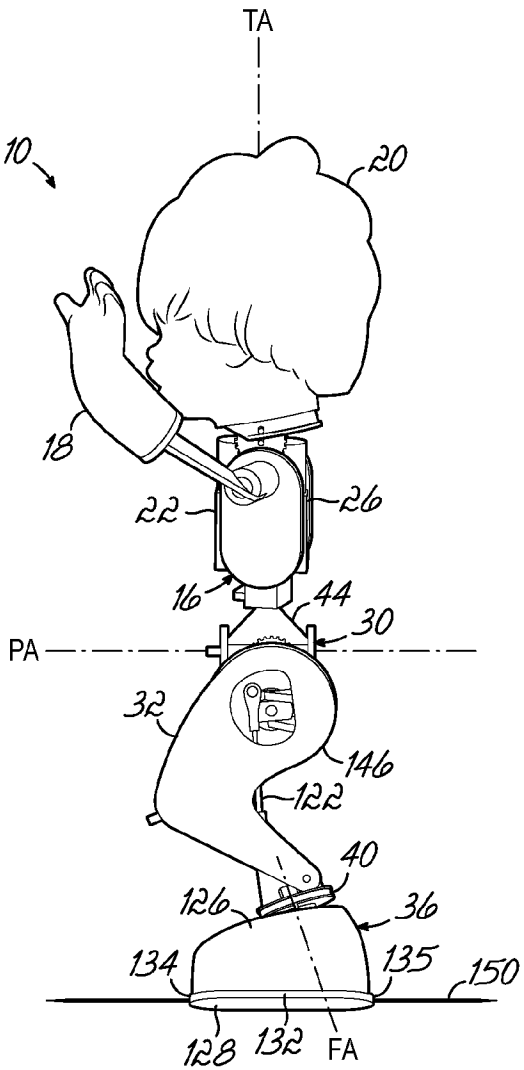
FIG. 5B is a side view of the motorized doll of FIG. 5A in the standing position.
Figure 5A:
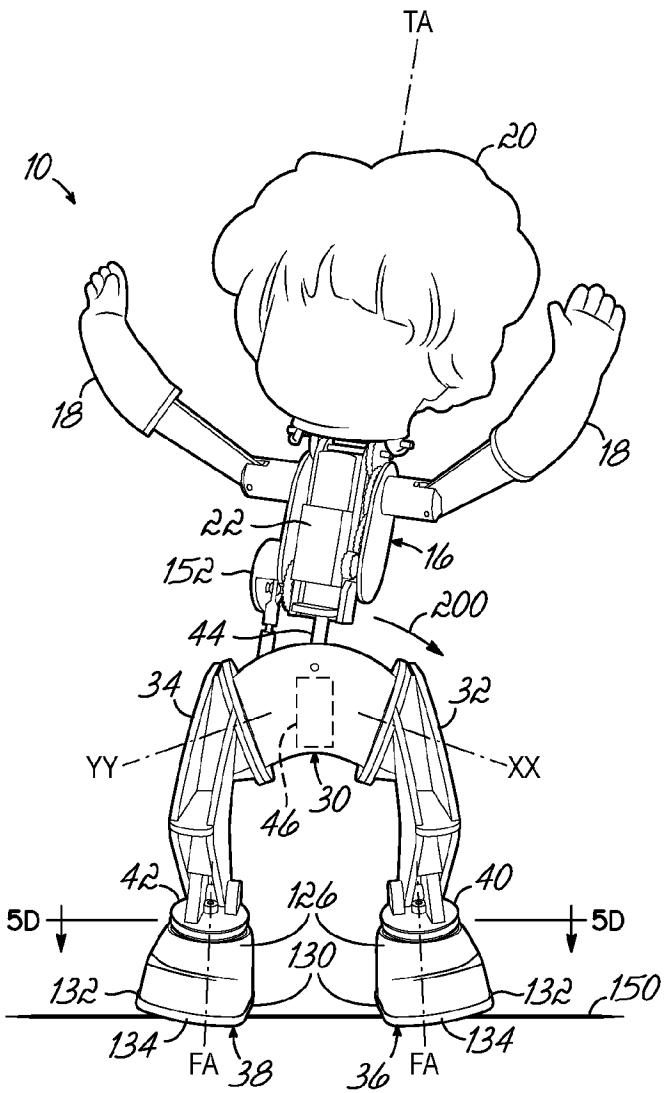
FIG. 5A is a front view of the motorized doll of FIG. 1, illustrating a standing position of the doll prior to walking.
Figure 5C:
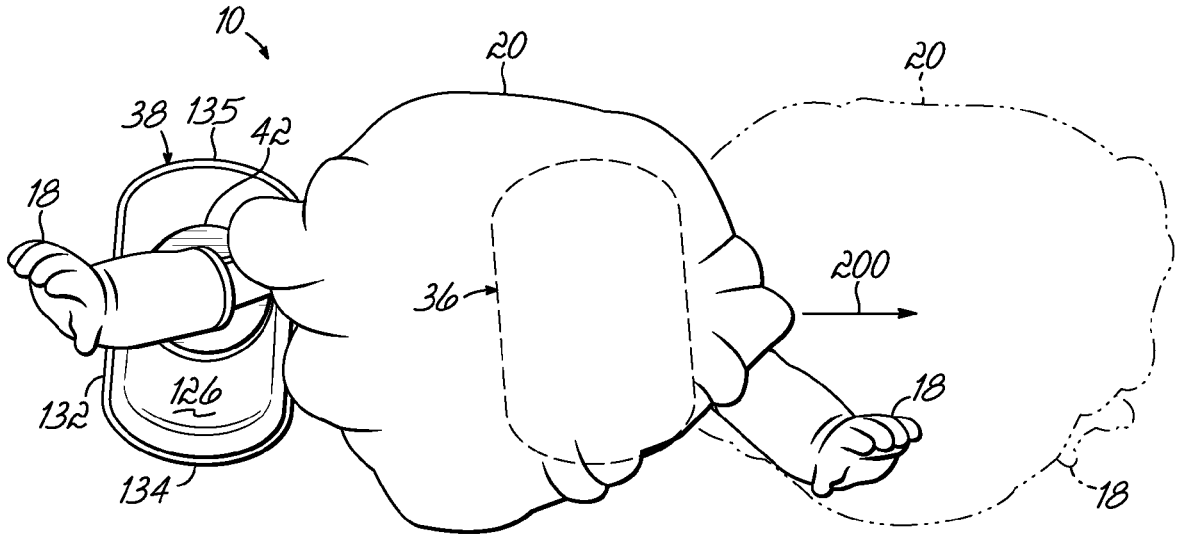
FIG. 5C is a top view of the motorized doll of FIG. 5A in the standing position.
Figure 5D:
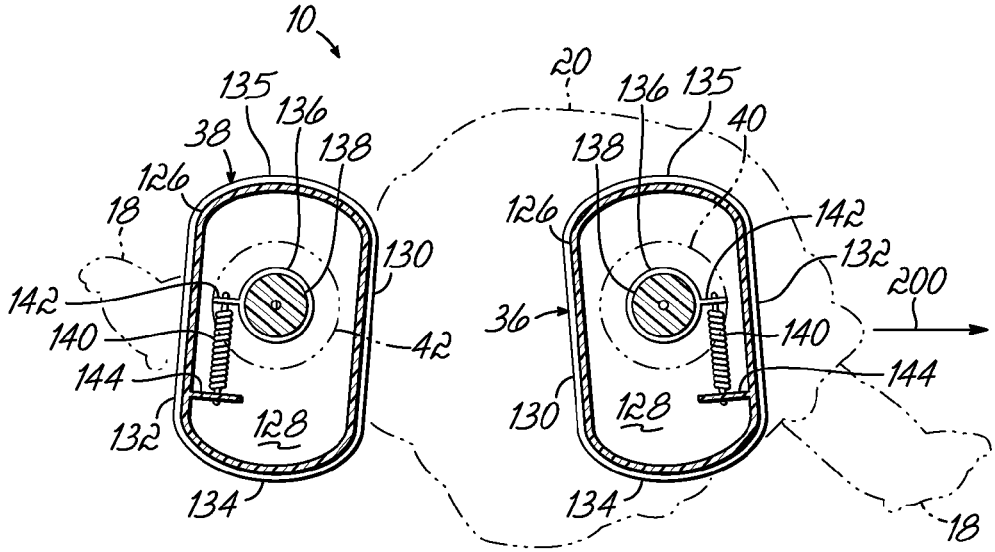
FIG. 5D is a top section view along line 5D-5D of the feet of the motorized doll of FIG. 5A in the standing position.

The walking operation of the motorized doll 10 is illustrated in the sequence of FIGS. 5A-7D. FIGS. 5A-5D depict an initial position of the doll 10 when the doll 10 is standing upright on a support surface 150 and ready to walk. In the initial position, the doll 10 and torso 16 are generally upright, and the pair of arms 18 and the head 20 may be rotated to any position such as the one shown in FIG. 5A. As shown most clearly in FIGS. 5C and 5D, the first and second feet 36, 38 are generally pointed forward in the nominal first position of the feet 36, 38 and the tension springs 140 within the feet 36, 38 are in a relaxed state. At this point the torso motor 26 is actuated to begin moving the torso 16 as previously described. The primary portion of the blended motion of the torso 16 is a tilting motion around pivot axis PA as shown by arrows 200 (FIGS. 5A, 5C, and 5D). As the torso 16 and head 20 move towards the left side of the doll 10 as shown in phantom in FIG. 5C, the entire weight of the doll 10 is shifted onto the first foot 36. Once this occurs, the doll 10 has moved to a first intermediate position.

Figure 6B:
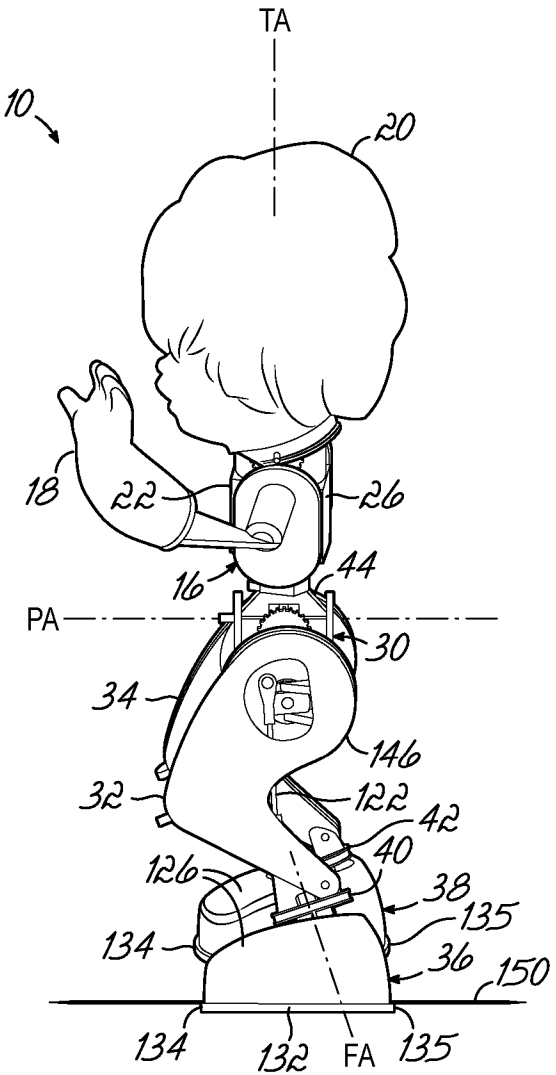
FIG. 6B is a side view of the motorized doll of FIG. 6A in the first intermediate position.
Figure 6A:
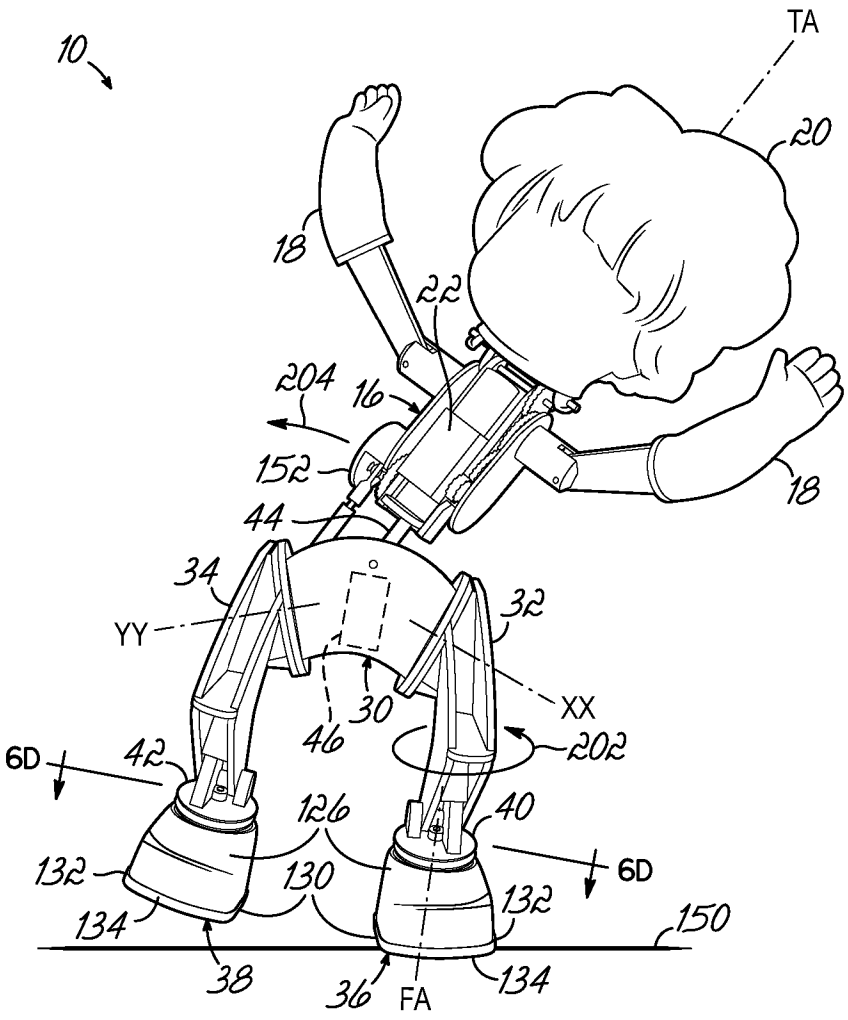
FIG. 6A is a front view of the motorized doll of FIG. 1, moved to a first intermediate position where the doll is supported solely on the first foot.
Figure 6C:
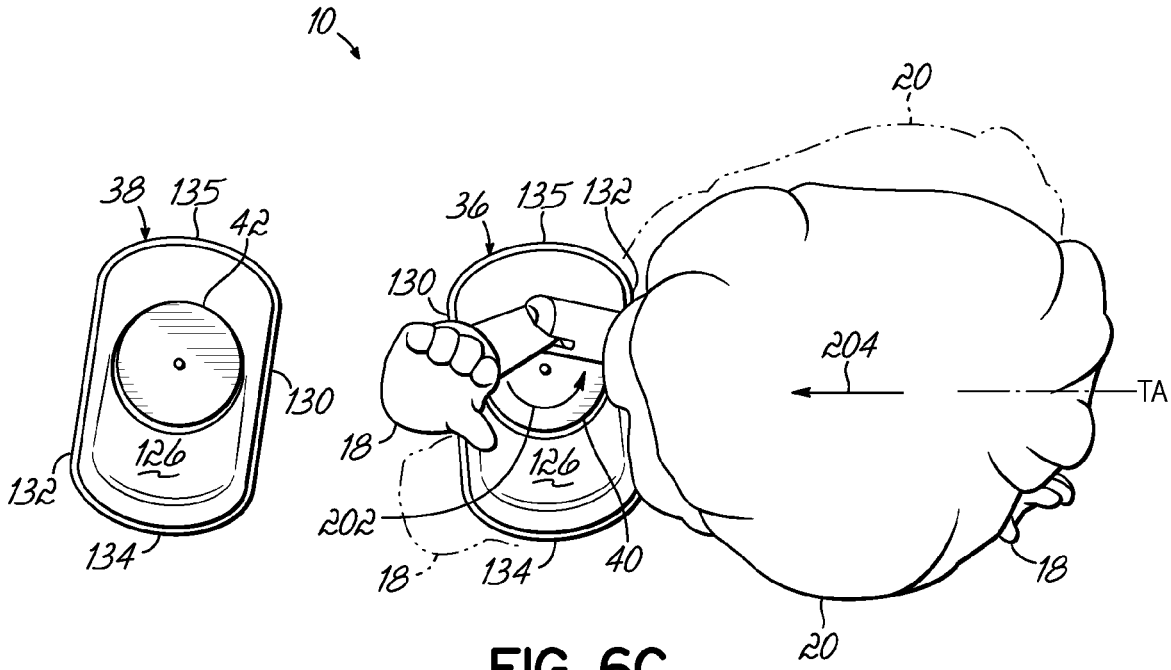
FIG. 6C is a partial top view of the motorized doll of FIG. 6A in the first intermediate position.
Figure 6D:
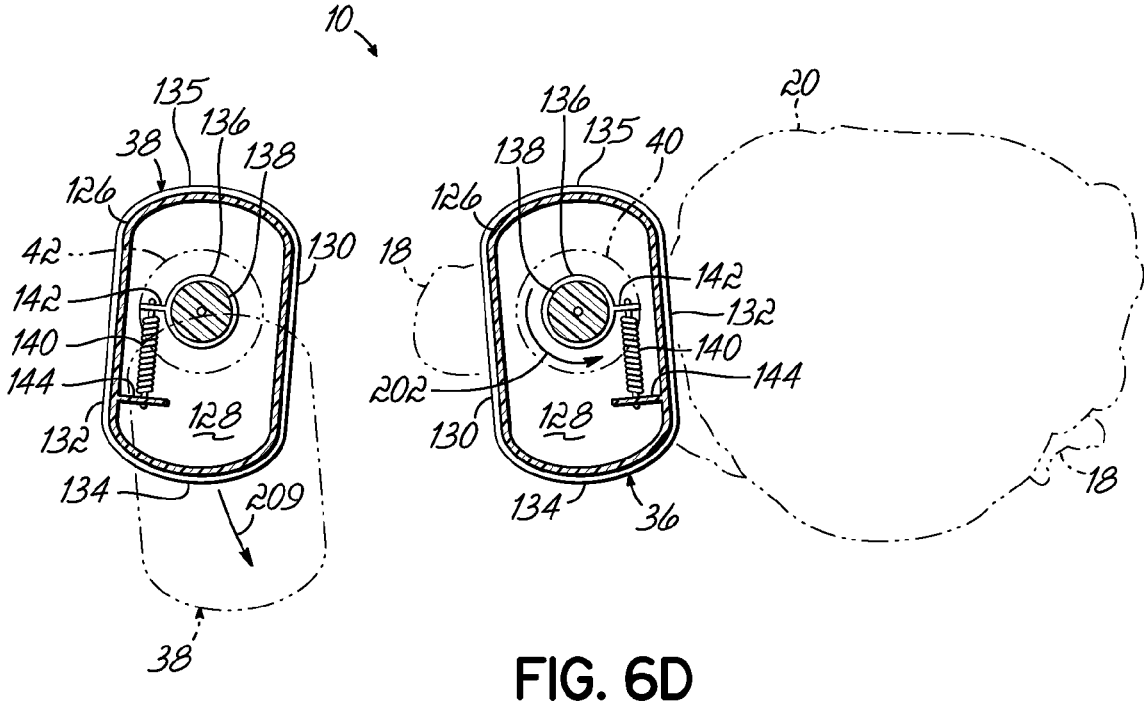
FIG. 6D is a top section view along line 6D-6D of the feet of the motorized doll of FIG. 6A in the first intermediate position.

The first intermediate position of the doll 10 is further illustrated in FIGS. 6A-6D. Once the entire weight of the doll 10 has shifted onto the first foot 36, the second foot 38 is completely lifted off the support surface 150. As the ball-and-socket joint of the torso drive train 28 begins to reverse the tilting direction of the torso 16, the entire doll 10, including the torso 16, pelvis 30, and first leg 32 is forced by its own mass to rotate with respect to the first foot 36 at the first ankle member 40 about the respective foot axis FA as illustrated by arrows 202 (FIGS. 6A, 6C and 6D). The doll 10 continues to rotate until the inner edge 130 of the second foot 38 comes back into contact with the support surface 150 at a location (shown in phantom in FIG. 6D) in front of the original location of the second foot 38. At approximately the same time that the second foot 38 comes into contact with the support surface 150, the torso drive train 28 has tilted the torso 16 about pivot axis PA back to a more upright position in the direction of arrows 204 (FIGS. 6A and 6C). Thus, the doll 10 has taken a small step forward with the second foot 38 as shown by arrow 209 (FIG. 6D).

Figure 7B:
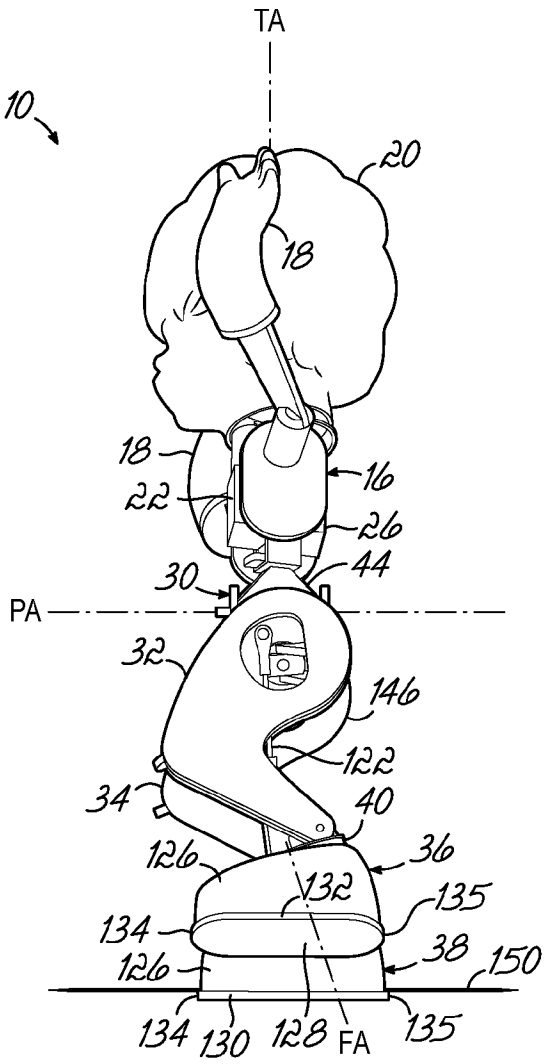
FIG. 7B is a side view of the motorized doll of FIG. 7A in the second intermediate position.
Figure 7A:
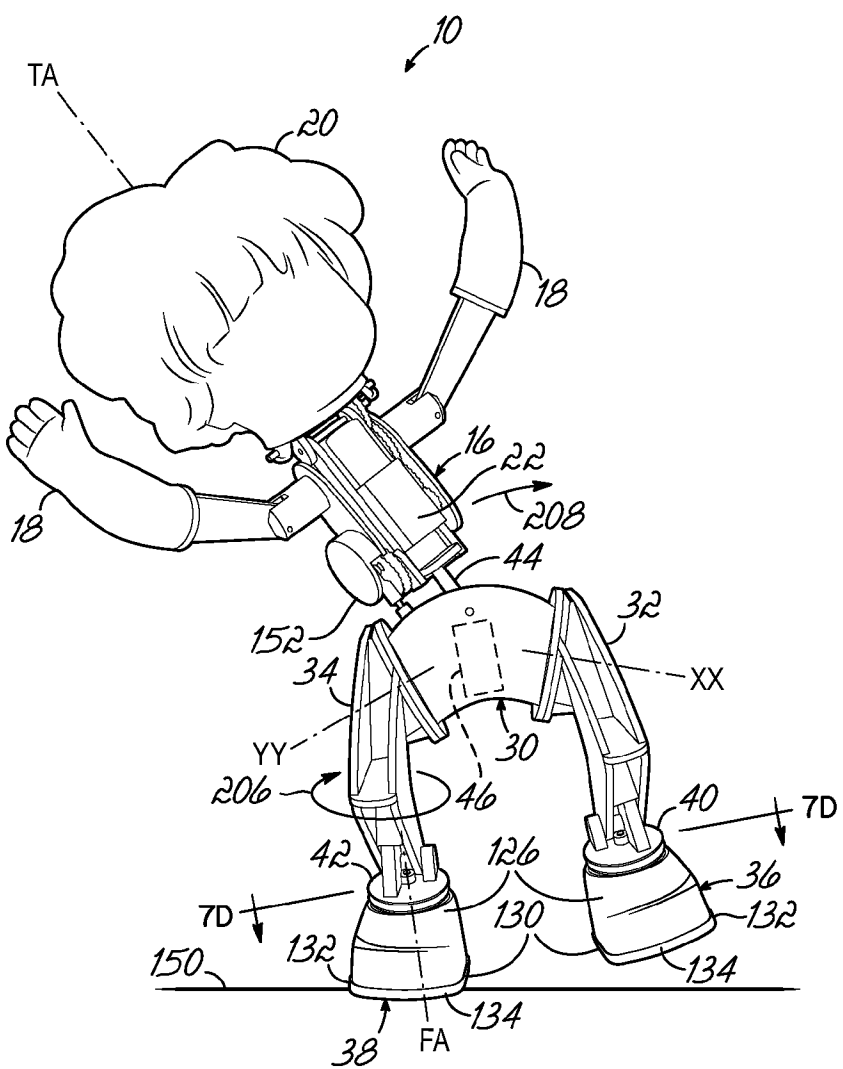
FIG. 7A is a front view of the motorized doll of FIG. 1, moved to a second intermediate position where the doll is supported solely on the second foot.
Figure 7C:
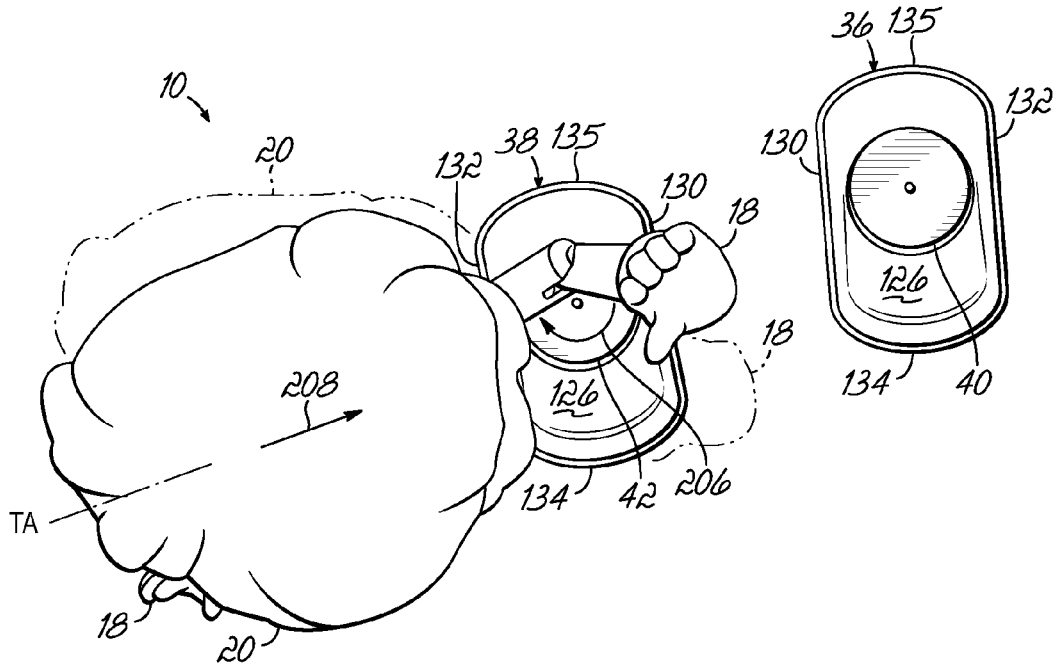
FIG. 7C is a partial top view of the motorized doll of FIG. 7A in the second intermediate position.
Figure 7D:
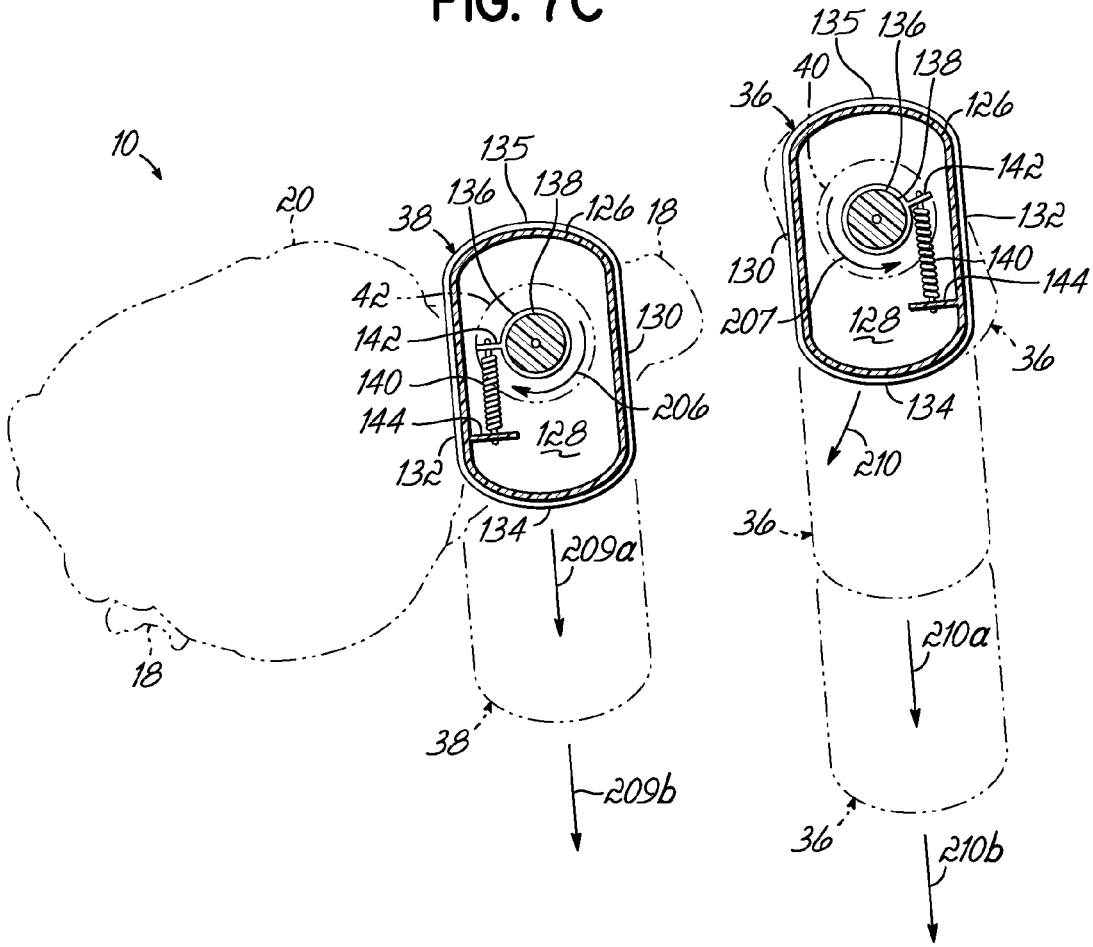
FIG. 7D is a top section view along line 7D-7D of the feet of the motorized doll of FIG. 7A in the second intermediate position.

The torso motor 26 continues to tilt the torso 16 to the right side of the doll 10 until the head 20 passes over the second leg 34 such that the entire weight of the doll is shifted onto the second foot 38 as shown in the second intermediate position illustrated in FIGS. 7A-7D. Similar to the reactions caused when the doll moved to the first intermediate position described above, the first foot 36 comes completely off the support surface 150. When this happens, the tension spring 140 within the first foot 36, which had been stretched (as shown in FIG. 7D) when the doll 10 rotated around the first foot 36 at the first intermediate position, pulls the first foot 36 about the respective foot axis FA as shown by arrow 207 back to the nominal first position (shown in phantom in FIG. 7D) such that the doll 10 will land correctly on the inner edge 130 of the first foot 36 in the next step. Meanwhile, the mass of the doll 10 forces the torso 16, pelvis 30, and second leg 34 to rotate with respect to the second foot 38 at the second ankle member 42 about the respective foot axis FA as illustrated by arrows 206 (FIGS. 7A, 7C and 7D). The doll 10 continues to rotate until the inner edge 130 of the first foot 36 comes back into contact with the support surface 150 at a location (shown in phantom in FIG. 7D) in front of the original location of the first foot 36. At approximately the same time that the first foot 36 comes into contact with the support surface 150, the torso drive train 28 has tilted the torso 16 about pivot axis PA back to a more upright position in the direction of arrows 208 (FIGS. 7A and 7C). Thus, the doll 10 has taken a step forward with the first foot 36 as shown by arrow 210 (FIG. 7D).

This cycle of shifting the weight onto each of the first and second feet 36, 38 and rotating the doll 10 forward may be repeated so that the doll 10 continues to take small steps forward as indicated by arrows 209*a*, 210*a*, 209*b*, 210*b* and further feet positions shown in phantom in FIG. 7D. As discussed previously, the blended motion of the torso 16 at the universal joint 44 allows the upper body portion 12 to have a realistic movement when the torso 16 causes the doll 10 to walk. Advantageously, the small steps caused by the interaction of the tilting motion of the torso 16 and the rotation of the first and second feet 36, 38 about respective foot axes FA appear relatively unsteady, which is similar to how an infant appears when taking tentative first steps in learning how to walk. Additional non-illustrated embodiments may include controlling the pair of arms 18 and the head 20 to rotate in a cycle with the walking motion to further enhance the realistic movement of the doll 10.

The movement of the motorized doll 10 between various predetermined positions is illustrated in FIGS. 8A-9F. More specifically, moving the doll 10 between a standing position and a sitting position is shown in FIGS. 8A-8D. Starting from a fully erect standing position as shown previously in FIG. 5A, the pelvis motor 46 and pelvis drive train 48 begin rotating the first and second legs 32, 34 with respect to the pelvis 30. As previously described, the rotation of the linking member 122 and the geometry of the first and second legs 32, 34 keep the center of gravity of the doll 10 behind the front tipping axis GG defined by the front edges 134 of the first and second feet 36, 38. As the pelvis motor 46 continues to operate, the doll 10 moves into a crouching position shown in FIGS. 8A and 8B. Once the doll 10 reaches this position, further rotation of the first and second legs 32, 34 with respect to the pelvis 30 will move the center of gravity over the tipping front axis GG and cause the doll 10 to fall forward onto the support surface 150 as shown by arrow 211 (FIG. 8B). In order to continue to the sitting position, the pair of arms 18 must be rotated to a generally outward direction from the torso 16 by the shoulder motor 22 prior to tipping the doll 10. This ensures that the doll 10 falls directly onto the pair of arms 18 as shown in the position of FIG. 8C.

Figure 8B:
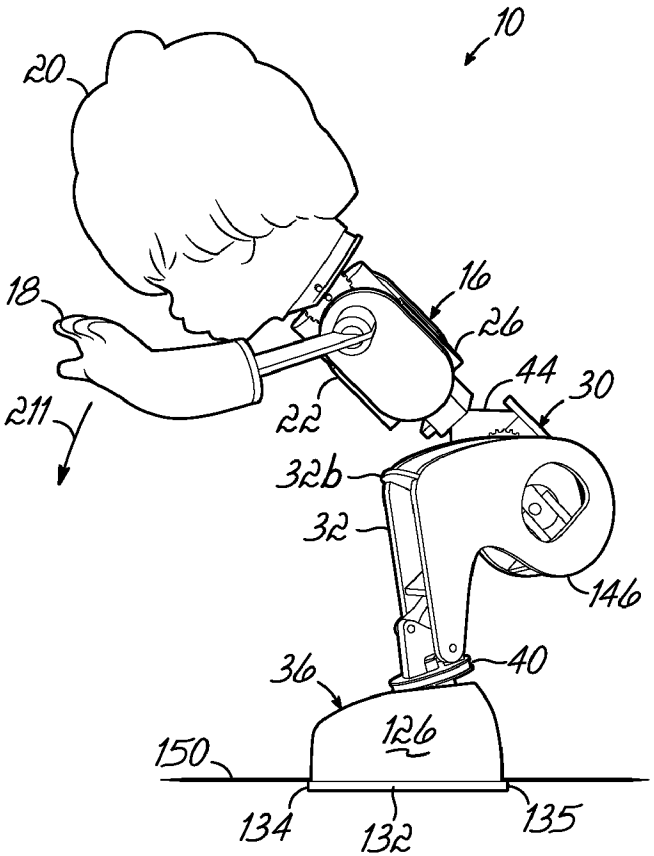
FIG. 8B is a side view of the motorized doll of FIG. 8A in the crouching position with a pair of arms positioned forward of the torso.
Figure 8A:
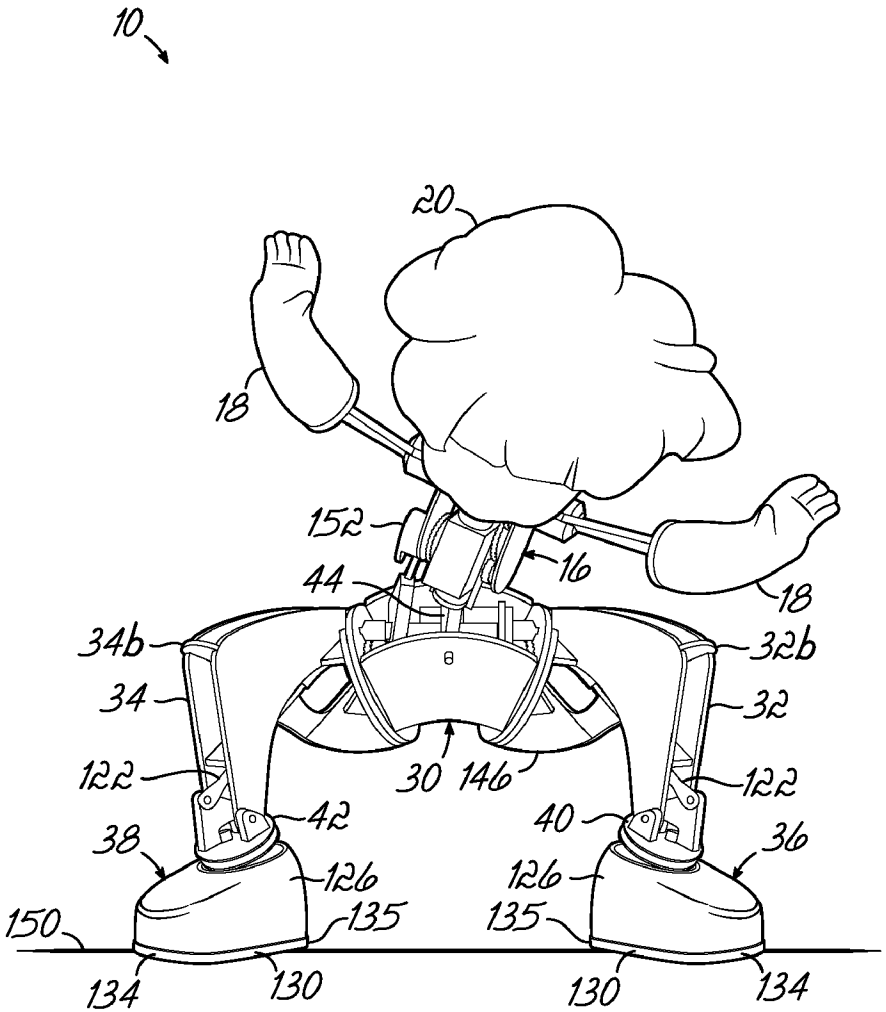
FIG. 8A is a front view of the motorized doll of FIG. 1 in a crouching position.
Figure 8D:
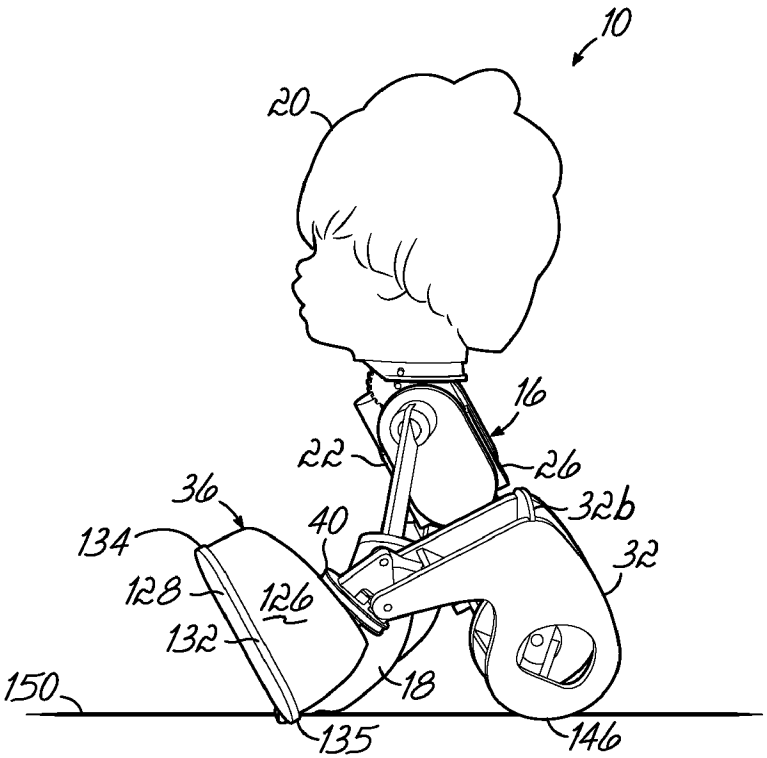
FIG. 8D is a side view of the motorized doll of FIG. 8A moved from the position of FIG. 8C to the sitting position.
Figure 8C:
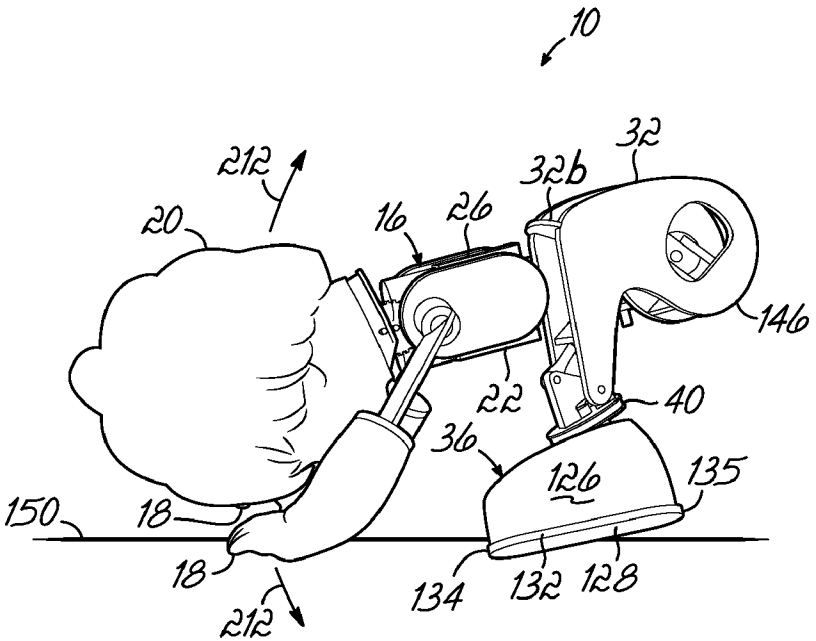
FIG. 8C is a side view of the motorized doll of FIG. 8A after the center of gravity has passed over the tipping axis of the motorized doll such that the doll is partially supported on the pair of arms.

Once the doll 10 reaches the position of FIG. 8C, the shoulder motor 22 may be engaged to push the pair of arms 18 further downward against the support surface 150. This rotation of the pair of arms 18 ensures that the doll 10 is tipped backwards over the rear tipping axis HH, as shown by arrows 212 (FIG. 8C), onto a buttocks area 146 defined by the pelvis 30 and the first and second legs 32, 34. Alternatively, continued movement of the first and second legs 32, 34 with the pelvis motor 46 can also tip the doll 10 backwards over the rear tipping axis HH onto the buttocks area 146. Once the doll 10 reaches this position shown in FIG. 8D, the pelvis motor 46 may be engaged in reverse to force the pelvis 30 to rotate to a position where the doll 10 is sitting up straight. To return the doll 10 to the standing position, the operation steps just discussed are performed in reverse. More specifically, the pelvis motor 46 forces the doll 10 back to the position of FIG. 8D, then the pair of arms 18 are rotated upwardly to push the doll 10 back to the tipped position of FIG. 8C, and a combination of downward movement of the pair of arms 18 accompanied by rotation of the first and second legs 32, 34 tips the doll 10 back to the crouched position, where it may then return to the standing position.

Figure 9B:
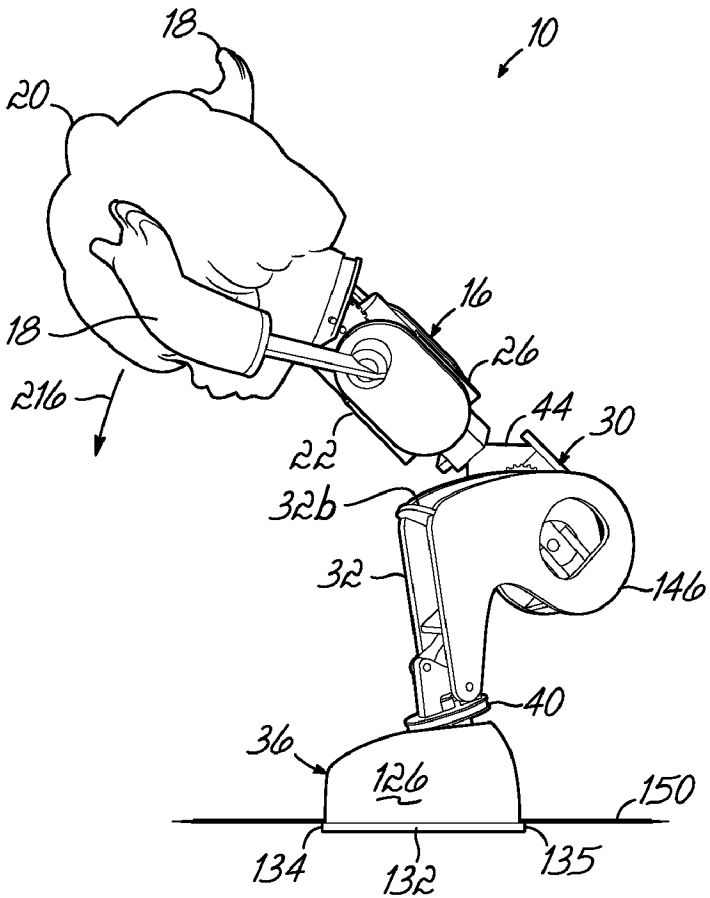
FIG. 9B is a side view of the motorized doll of FIG. 9A in the crouching position with a pair of arms positioned adjacent the head.
Figure 9A:
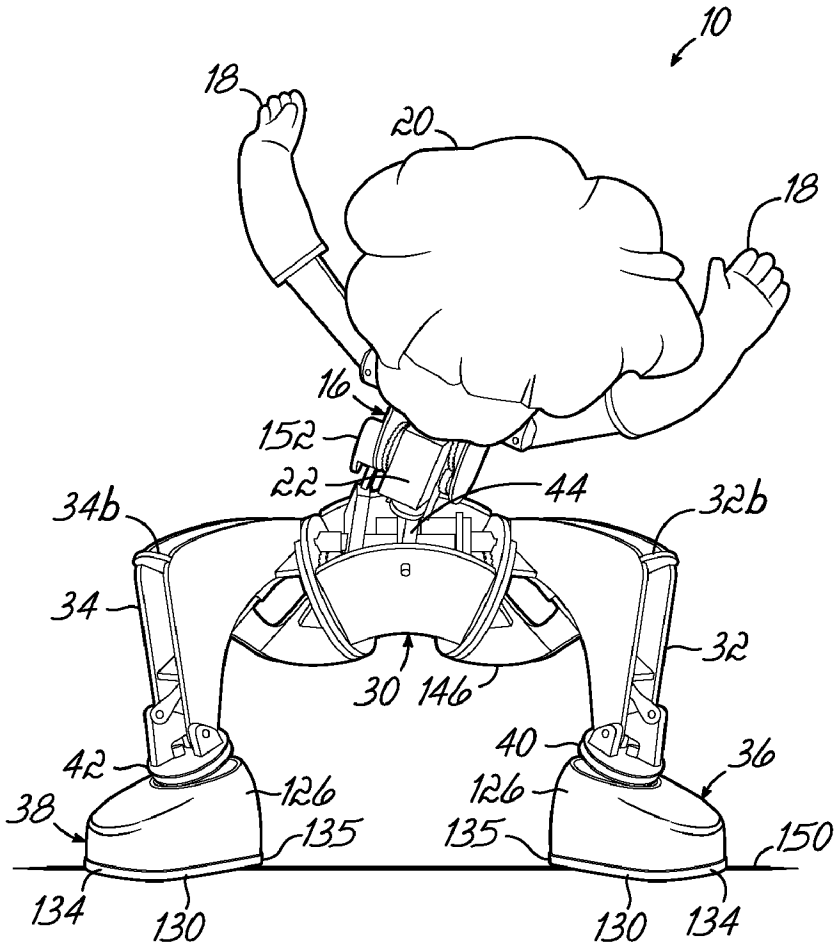
FIG. 9A is a front view of the motorized doll of FIG. 1 in a crouching position.
Figure 9C:
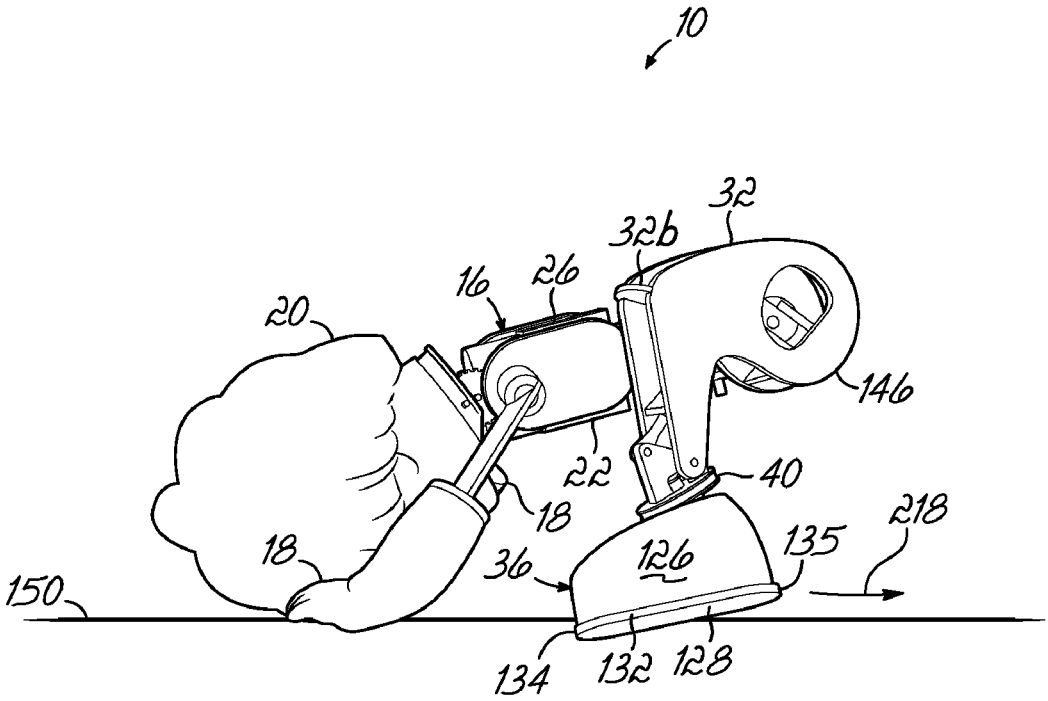
FIG. 9C is a side view of the motorized doll of FIG. 9A after the center of gravity has passed over the tipping axis of the motorized doll such that the doll is supported on the pair of arms and the head.
Figure 9D:
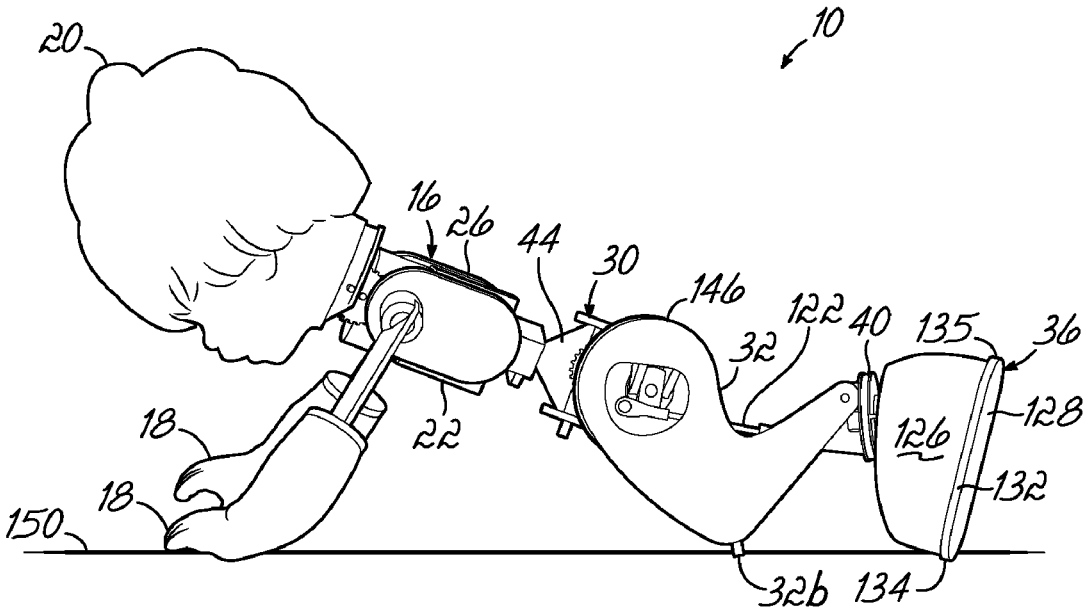
FIG. 9D is a side view of the motorized doll of FIG. 9A moved from the position of FIG. 9C to the crawling position.

In a similar manner, the motorized doll 10 may be moved between a standing position and a crawling position. To move from the standing position to the crouching position of FIGS. 9A and 9B, the same movements as described above of the first and second legs 32, 34 with respect to the pelvis 30 are completed. Once the doll 10 reaches this position, further rotation of the first and second legs 32, 34 with respect to the pelvis 30 will move the center of gravity over the front tipping axis GG and cause the doll 10 to fall forward onto the support surface 150 as shown by arrow 216 (FIG. 9B). In order to continue to the crawling position, the pair of arms 18 must be rotated to a generally upward direction near the head 20 and the arms 18 by the shoulder motor 22 prior to tipping the doll 10. This ensures that the doll 10 falls onto the head 20 as shown in the position of FIG. 9C. Advantageously, the pair of arms 18 do not push the doll 10 to tip backwards into the sitting position in this orientation, as the first and second feet 36, 38 are tipped partially forward at the front edges 134.

Once the doll 10 reaches the position of FIG. 9C, the pelvis motor 46 is further actuated in a reverse direction to rotate the first and second legs 32, 34 backwards with respect to the pelvis 30 as shown by arrow 218 (FIG. 9C). This movement is similar to the movement of the doll from the crouching position to the standing position, just on the support surface 150. As the first and second legs 32, 34 continue to rotate, the knee sections 32*b*, 34*b* will come into contact with the support surface 150 and support the lower body portion 14. At the same time, the shoulder motor 22 is actuated to rotate the pair of arms 18 downward towards the support surface 150 and rotate the head 20 backwards such that the upper body portion 12 is supported on the pair of arms 18. When the doll 10 is supported on the knee portions 32*b*, 34*b* and the pair of arms 18, the doll 10 has reached a crawling position shown in FIG. 8D. Once the doll 10 reaches this crawling position, the head 20 has been rotated to a realistic forward-looking direction for crawling.

Figure 9E:
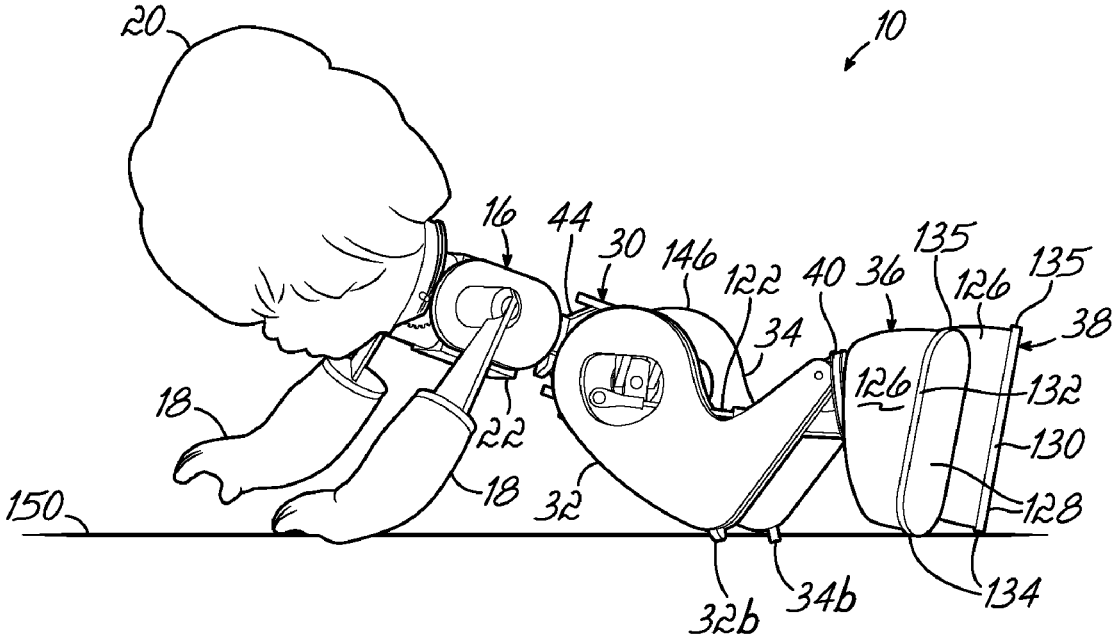
FIG. 9E is a side view of the motorized doll of FIG. 9A illustrating the torso movements inducing a crawling movement.
Figure 9F:
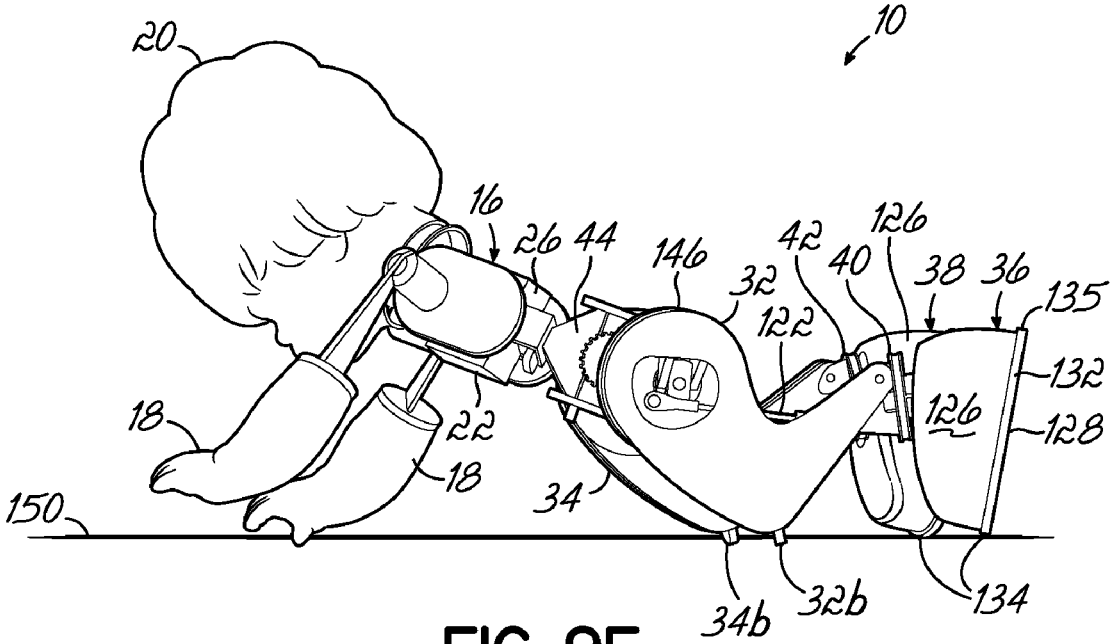
FIG. 9F is a side view of the motorized doll of FIG. 9A illustrating further torso movements inducing a crawling movement.

In the crawling position, the doll 10 crawls using the same mechanism as the walking operation. The torso motor 26 is actuated to tilt and rotate the torso 16 with respect to the pelvis 30 at the universal joint 44. Rather than tipping the doll 10 from foot to foot, now the movements of the torso 16 cause the pair of arms 18 to move generally forward in a circular fashion as shown in FIGS. 9E and 9F, which propels the lower body portion 14 to shuffle forwards at the knee portions 32*b*, 34*b*. The torso motor 26 may also be engaged in a reverse direction to shuffle the lower body portion 14 backwards, thereby forming a realistic crawling motion in either direction. As with the sitting position, the doll 10 can be returned from the crawling position to the standing position by reversing the above-described operational process. Thus, the motorized doll 10 can realistically move between a standing position, a sitting position, a crouching position, and a crawling position.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. For example, the pelvis motor 46 and universal joint 44 could be modified to only allow tilting motion of the torso 16 about pivot axis PA without a corresponding left-and-right rotation of the torso 16 about torso axis TA. Furthermore, the shoulder drive train 24 may be modified so that only the pair of arms 18 is rotated while the head 20 remains in a single position. The various features of the invention may be used alone or in numerous combinations depending on the needs and preferences of the user.

What is claimed is:

1. A motorized doll adapted to walk on a support surface, comprising:

an upper body portion including a torso;

a lower body portion including a pelvis, first and second legs extending from the pelvis, and first and second feet coupled to the respective legs such that the first and second feet may rotate with respect to the first and second legs along respective first and second generally vertical foot axes;

a universal joint rotatably coupled to the torso along a torso axis, the universal joint also being rotatably coupled to the pelvis along a generally horizontal pivot axis which is generally perpendicular to the torso axis;

a torso motor positioned in the upper body portion; and a pivot crank having first and second ends, the first end being operatively coupled to the torso motor, the second end being rotatably coupled to the pelvis along a crank axis which is generally parallel to the pivot axis;

wherein the torso pivots about the torso axis and the pivot axis simultaneously when the torso motor is operative, thereby inducing the doll to walk on the support surface, and wherein when the doll is laying down on the support surface, the torso motor induces crawling movement by pivoting the torso about the torso axis and the pivot axis simultaneously.

2. The motorized doll of claim 1, wherein the upper body portion further includes a head and a pair of arms coupled to the torso, and the motorized doll further comprising a shoulder motor operable to move the pair of arms.

3. The motorized doll of claim 2, wherein the shoulder motor is further operable to move the head.

4. The motorized doll of claim 2, further comprising a controller operable to control the torso motor and the shoulder motor.

5. The motorized doll of claim 1, wherein each of the first and second feet includes a bottom surface having an inner edge, and the first and second legs are angled with respect to the pelvis such that the doll stands on the inner edges of the first and second feet.

6. The motorized doll of claim 5, wherein each of the first and second feet includes a spring that biases the first or second foot towards a nominal first position with respect to the first or second leg.

7. A motorized doll, the doll comprising:

an upper body portion including a torso, a pair of arms rotatably coupled to the torso about an arm axis, and a head coupled to the torso;

a lower body portion including a pelvis, first and second legs rotatably coupled to the pelvis about respective first and second hip axes, and first and second feet rotatably coupled to the respective first and second legs about respective first and second generally horizontal ankle axes;

a shoulder motor positioned in the torso and operatively coupled to the pair of arms;

a pelvis motor positioned in the pelvis and operatively coupled to the first and second legs;

a universal joint coupling the torso to the pelvis about a generally horizontal pivot axis through the pelvis;

a torso motor positioned in the upper body portion, the torso motor operable to drive the torso from side to side about the pivot axis; and first and second linking members, each linking member having first and second ends, the first end of each linking member being coupled to an opposing side of the pelvis, the second end of each linking member being coupled to a respective first or second foot, wherein the linking members cause the first and second feet to rotate about the ankle axes when the pelvis motor rotates the first and second legs about the hip axes, thereby moving the doll from a standing position to a crouching position.

8. The motorized doll of claim 7, further comprising a controller operable to control the shoulder motor, the pelvis motor, and the torso motor.

* * * * *